US007030781B2

(12) United States Patent
Jones

(10) Patent No.: US 7,030,781 B2
(45) **Date of Patent: *Apr. 18, 2006**

(54) NOTIFICATION SYSTEM AND METHOD THAT INFORMS A PARTY OF VEHICLE DELAY

(75) Inventor: Martin Kelly Jones, Dalton, GA (US)

(73) Assignee: ArrivalStar, Inc., Delray Beach, FL (US)

( * ) Notice: Subject to any disclaimer, the term of this patent is extended or adjusted under 35 U.S.C. 154(b) by 24 days.

This patent is subject to a terminal disclaimer.

(21) Appl. No.: 10/686,925

(22) Filed: Oct. 16, 2003

(65) Prior Publication Data

US 2004/0083054 A1 Apr. 29, 2004

Related U.S. Application Data

(63) Continuation of application No. 09/992,817, filed on Nov. 6, 2001, now Pat. No. 6,700,507, which is a continuation of application No. 09/233,795, filed on Jan. 19, 1999, now Pat. No. 6,313,760, which is a continuation of application No. 08/407,319, filed on Mar. 20, 1995, now abandoned, which is a continuation-in-part of application No. 08/063,533, filed on May 18, 1993, now Pat. No. 5,400,020.

(51) Int. Cl.
*G08G 1/123* (2006.01)

(52) U.S. Cl. ..... 340/994; 340/989; 701/201; 701/213

(58) Field of Classification Search ..... 340/994, 340/988, 989; 379/59; 701/211, 117, 213, 701/201

See application file for complete search history.

(56) References Cited

U.S. PATENT DOCUMENTS

| | | | | |
|---|---|---|---|---|
| 3,568,161 | A | 3/1971 | Knickel | 340/994 |
| 3,644,883 | A | 2/1972 | Borman et al. | 340/23 |
| 3,845,289 | A | 10/1974 | French | 235/151.2 |
| 3,886,515 | A | 5/1975 | Cottin et al. | 340/994 |
| 3,934,125 | A | 1/1976 | Macano | 235/150.2 |

(Continued)

FOREIGN PATENT DOCUMENTS

| | | | |
|---|---|---|---|
| EP | 0219859 | A2 | 4/1987 |
| EP | 0805427 | A1 | 11/1997 |

(Continued)

OTHER PUBLICATIONS

Moriok, et al., "Advanced Vehicle Monitoring and communication Systems for Bus Transit—Benefits and Economic Feasibility", Final Report—U.S. Department of Transportation, Sep. 1991, Revised Mar. 1993, Dot–T–94–03.

(Continued)

*Primary Examiner*—Brent A. Swarthout
(74) *Attorney, Agent, or Firm*—Thomas, Kayden, Horstemeyer & Risley, LLP

(57) ABSTRACT

An advance notification system and method notifies passengers of the impending arrival of a transportation vehicle, for example, a school bus, at a particular vehicle stop. The system generally includes an on-board vehicle control unit for each vehicle and a base station control unit for making telephone calls to passengers in order to inform the passengers when the vehicle is a certain predefined time period and/or distance away from the vehicle stop. The VCU compares elapsed time and/or traveled distance to the programmed scheduled time and/or traveled distance to determine if the vehicle is on schedule. If the vehicle is behind or ahead of schedule, the VCU calls the BSCU, which then adjusts its calling schedule accordingly.

14 Claims, 7 Drawing Sheets

U.S. PATENT DOCUMENTS

| | | | | | |
|---|---|---|---|---|---|
| 4,220,946 | A | | 9/1980 | Henriot | 340/23 |
| 4,297,672 | A | | 10/1981 | Fruchey et al. | 340/23 |
| 4,325,057 | A | | 4/1982 | Bishop | 340/539 |
| 4,350,969 | A | * | 9/1982 | Greer | 340/994 |
| 4,525,601 | A | | 6/1985 | Barnich et al. | 379/7 MM |
| 4,585,904 | A | | 4/1986 | Mincone et al. | 179/7.1 TP |
| 4,713,661 | A | | 12/1987 | Boone et al. | 340/994 |
| 4,791,571 | A | | 12/1988 | Takahashi et al. | 364/436 |
| 4,799,162 | A | * | 1/1989 | Shinkawa et al. | 701/117 |
| 4,804,837 | A | | 2/1989 | Farley | 250/251 |
| 4,804,937 | A | | 2/1989 | Barbiaux et al. | 340/52 F |
| 4,812,843 | A | | 3/1989 | Champion, III et al. | 340/905 |
| 4,813,065 | A | | 3/1989 | Segala | 379/112 |
| 4,857,925 | A | | 8/1989 | Brubaker | 340/994 |
| 4,894,649 | A | | 1/1990 | Davis | 340/825.44 |
| 4,956,777 | A | | 9/1990 | Cearley et al. | 364/424.02 |
| 5,003,584 | A | | 3/1991 | Benyacar et al. | 379/119 |
| 5,006,847 | A | * | 4/1991 | Rush et al. | 340/994 |
| 5,014,206 | A | | 5/1991 | Scribner et al. | 364/449 |
| 5,021,780 | A | | 6/1991 | Fabiano et al. | 340/994 |
| 5,021,789 | A | | 6/1991 | Fabiano et al. | 264/436 |
| 5,048,079 | A | | 9/1991 | Harrington et al. | 379/112 |
| 5,068,656 | A | | 11/1991 | Sutherland | 340/989 |
| 5,097,429 | A | | 3/1992 | Wood et al. | 364/569 |
| 5,103,475 | A | | 4/1992 | Shuen | 379/115 |
| 5,113,185 | A | | 5/1992 | Ichikawa | 340/995 |
| 5,121,326 | A | | 6/1992 | Moroto et al. | 364/449 |
| 5,122,959 | A | | 6/1992 | Nathanson et al. | 364/436 |
| 5,131,020 | A | | 7/1992 | Liebesny et al. | 379/59 |
| 5,144,301 | A | | 9/1992 | Jackson et al. | 340/994 |
| 5,146,491 | A | | 9/1992 | Silver et al. | 379/114 |
| 5,155,689 | A | | 10/1992 | Wortham | 364/460 |
| 5,168,451 | A | | 12/1992 | Bolger | 364/436 |
| 5,179,584 | A | | 1/1993 | Tsumura | 379/114 |
| 5,218,629 | A | | 6/1993 | Dumond, Jr. et al. | 379/59 |
| 5,218,632 | A | | 6/1993 | Cool | 379/126 |
| 5,223,844 | A | | 6/1993 | Mansell et al. | 342/357 |
| 5,243,529 | A | | 9/1993 | Kashiwazaki | 364/449 |
| 5,271,484 | A | | 12/1993 | Bahjat et al. | 187/29.1 |
| 5,299,132 | A | | 3/1994 | Wortham | 364/460 |
| 5,323,456 | A | | 6/1994 | Oprea | 379/375 |
| 5,351,194 | A | | 9/1994 | Ross et al. | 364/449 |
| 5,361,296 | A | | 11/1994 | Reyes et al. | 379/96 |
| 5,381,338 | A | | 1/1995 | Wysocki et al. | 364/449 |
| 5,381,467 | A | | 1/1995 | Rosinski et al. | 379/121 |
| 5,394,332 | A | | 2/1995 | Kuwahara et al. | 364/449 |
| 5,398,190 | A | | 3/1995 | Wortham | 364/460 |
| 5,400,020 | A | | 3/1995 | Jones | 340/994 |
| 5,420,794 | A | | 5/1995 | James | 364/436 |
| 5,428,546 | A | | 6/1995 | Shah et al. | 364/449 |
| 5,432,841 | A | | 7/1995 | Rimer | 379/59 |
| 5,440,489 | A | | 8/1995 | Newman | 364/426.05 |
| 5,444,444 | A | * | 8/1995 | Ross | 340/994 |
| 5,446,678 | A | | 8/1995 | Saltzstein et al. | 364/514 |
| 5,448,479 | A | | 9/1995 | Kemner et al. | 365/424.02 |
| 5,461,374 | A | | 10/1995 | Lewiner et al. | 340/994 |
| 5,483,234 | A | | 1/1996 | Correel et al. | 340/994 |
| 5,483,454 | A | | 1/1996 | Lewiner et al. | 364/443 |
| 5,493,295 | A | | 2/1996 | Lewiner et al. | 340/994 |
| 5,493,694 | A | | 2/1996 | Vlcek et al. | 455/53.1 |
| 5,506,893 | A | | 4/1996 | Buscher et al. | 379/114 |
| 5,513,111 | A | | 4/1996 | Wortham | 364/460 |
| 5,515,421 | A | | 5/1996 | Sikand et al. | 379/67 |
| 5,519,621 | A | | 5/1996 | Wortham | 364/460 |
| 5,526,401 | A | | 6/1996 | Roach, Jr. et al. | 379/59 |
| 5,539,810 | A | | 7/1996 | Kennedy, III et al. | 379/59 |
| 5,544,225 | A | | 8/1996 | Kennedy, III et al. | 379/59 |
| 5,546,444 | A | | 8/1996 | Roach, Jr. et al. | 379/59 |
| 5,552,795 | A | | 9/1996 | Tayloe et al. | 342/357 |
| 5,559,871 | A | | 9/1996 | Smith | 379/115 |
| 5,570,100 | A | | 10/1996 | Grube et al. | 364/446 |
| 5,577,101 | A | | 11/1996 | Bohm | 379/58 |
| 5,579,376 | A | | 11/1996 | Kennedy, III et al. | 379/60 |
| 5,587,715 | A | | 12/1996 | Lewis | 342/357 |
| 5,594,650 | A | | 1/1997 | Shah et al. | 364/449.1 |
| 5,594,787 | A | | 1/1997 | Ohshima et al. | 379/114 |
| 5,602,739 | A | | 2/1997 | Haagenstad et al. | 364/436 |
| 5,623,260 | A | | 4/1997 | Jones | 340/994 |
| 5,648,770 | A | | 7/1997 | Ross | 340/994 |
| 5,652,707 | A | | 7/1997 | Wortham | 364/460 |
| 5,657,010 | A | | 8/1997 | Jones | 340/994 |
| 5,668,543 | A | | 9/1997 | Jones | 340/994 |
| 5,673,305 | A | | 9/1997 | Ross | 379/58 |
| 5,680,119 | A | | 10/1997 | Magliari et al. | 340/904 |
| 5,694,322 | A | | 12/1997 | Westerlage et al. | 364/464 |
| 5,694,459 | A | | 12/1997 | Backaus et al. | 379/427 |
| 5,699,275 | A | | 12/1997 | Beasley et al. | 364/514 R |
| 5,712,908 | A | | 1/1998 | Brinkman et al. | 379/119 |
| 5,715,307 | A | | 2/1998 | Zazzera | 379/265 |
| 5,719,771 | A | | 2/1998 | Buck et al. | 364/443 |
| 5,724,243 | A | | 3/1998 | Westerlage et al. | 364/446 |
| 5,724,584 | A | | 3/1998 | Peters et al. | 395/671 |
| 5,729,597 | A | | 3/1998 | Bhusri | 379/115 |
| 5,732,074 | A | | 3/1998 | Spaur et al. | 370/313 |
| 5,734,981 | A | | 3/1998 | Kennedy, III et al. | 455/445 |
| 5,736,940 | A | | 4/1998 | Burgener | 340/994 |
| 5,739,774 | A | | 4/1998 | Olandesi | 340/994 |
| 5,742,672 | A | | 4/1998 | Burk | 379/198 |
| 5,751,245 | A | | 5/1998 | Janky et al. | 342/357 |
| 5,760,742 | A | | 6/1998 | Branch et al. | 342/457 |
| 5,771,282 | A | | 6/1998 | Friedes | 379/121 |
| 5,771,455 | A | | 6/1998 | Kennedy, III et al. | 455/456 |
| 5,774,825 | A | | 6/1998 | Reynolds | 364/449.7 |
| 5,781,156 | A | | 7/1998 | Krasner | 342/357 |
| 5,784,443 | A | | 7/1998 | Chapman et al. | 379/119 |
| 5,793,853 | A | | 8/1998 | Sbisa | 379/120 |
| 5,796,365 | A | | 8/1998 | Lewis | 342/357 |
| 5,799,073 | A | | 8/1998 | Fleischer, III et al. | 379/113 |
| 5,799,263 | A | | 8/1998 | Culbertson | 701/117 |
| 5,805,680 | A | | 9/1998 | Penzias | 379/118 |
| 5,808,565 | A | | 9/1998 | Matta et al. | 340/994 |
| RE35,920 | E | | 10/1998 | Sorden et al. | 342/457 |
| 5,835,580 | A | | 11/1998 | Frazer | 379/115 |
| 5,841,847 | A | | 11/1998 | Graham et al. | 379/114 |
| 5,852,659 | A | | 12/1998 | Welter, Jr. | 379/116 |
| 5,864,610 | A | | 1/1999 | Ronen | 379/127 |
| 5,875,238 | A | | 2/1999 | Glitho et al. | 379/116 |
| 5,881,138 | A | | 3/1999 | Kearns et al. | 379/114 |
| 5,910,979 | A | | 6/1999 | Goel et al. | 379/120 |
| 5,912,954 | A | | 6/1999 | Whited et al. | 379/115 |
| 5,915,006 | A | | 6/1999 | Jagadish et al. | 379/127 |
| 5,920,613 | A | | 7/1999 | Alcott et al. | 379/114 |
| 5,922,040 | A | | 7/1999 | Prabhakaran | 701/117 |
| 5,937,044 | A | | 8/1999 | Kim | 379/121 |
| 5,943,320 | A | | 8/1999 | Weik et al. | 370/259 |
| 5,943,406 | A | | 8/1999 | Leta et al. | 379/120 |
| 5,943,657 | A | | 8/1999 | Freestone et al. | 705/400 |
| 5,945,919 | A | | 8/1999 | Trask | 340/825.491 |
| 5,946,379 | A | | 8/1999 | Bhusri | 379/115 |
| 5,950,174 | A | | 9/1999 | Brendzel | 705/34 |
| 5,955,974 | A | | 9/1999 | Togawa | 340/994 |
| 5,956,391 | A | | 9/1999 | Melen et al. | 379/114 |
| 5,982,864 | A | | 11/1999 | Jagadish et al. | 379/115 |
| 5,987,108 | A | | 11/1999 | Jagadish et al. | 379/114 |
| 5,987,377 | A | | 11/1999 | Westerlage et al. | 701/204 |
| 5,991,377 | A | | 11/1999 | Malik | 379/114 |
| 5,991,380 | A | | 11/1999 | Bruno et al. | 379/115 |
| 5,991,381 | A | | 11/1999 | Bouanaka et al. | 379/115 |
| 5,995,602 | A | | 11/1999 | Johnson et al. | 379/116 |
| 6,006,159 | A | | 12/1999 | Schmier et al. | 701/200 |
| 6,094,149 | A | | 7/2000 | Wilson | 340/904 |

| | | | | |
|---|---|---|---|---|
| 6,097,317 | A | 8/2000 | Lewiner et al. | 340/994 |
| 6,111,538 | A | 8/2000 | Schuchman et al. | 342/357 |
| 6,124,810 | A | 9/2000 | Segal et al. | 340/994 |
| 6,134,501 | A | 10/2000 | Oumi | 701/209 |
| 6,137,425 | A | 10/2000 | Oster et al. | 340/994 |
| 6,144,301 | A | 11/2000 | Frieden | 340/572.8 |
| 6,178,378 | B1 | 1/2001 | Leibold | 701/202 |
| 6,184,802 | B1 | 2/2001 | Lamb | 340/994 |
| 6,191,708 | B1 | 2/2001 | Davidson | 240/994 |
| 6,222,462 | B1 | 4/2001 | Hahn | 340/904 |
| 6,240,362 | B1 | 5/2001 | Gaspard, II | 701/209 |
| 6,253,146 | B1 | 6/2001 | Hanson et al. | 701/202 |
| 6,253,148 | B1 | 6/2001 | Decaux et al. | 701/204 |
| 6,278,936 | B1 | 8/2001 | Jones | 701/201 |
| 6,313,760 | B1 | 11/2001 | Jones | 340/994 |
| 6,317,060 | B1 | 11/2001 | Jones | 340/994 |
| 6,360,101 | B1 | 3/2002 | Irvin | 455/456 |
| 6,363,254 | B1 | 3/2002 | Jones et al. | 455/456 |
| 6,363,323 | B1 | 3/2002 | Jones | 701/213 |
| 6,374,176 | B1 | 4/2002 | Schmier et al. | 701/200 |
| 6,400,956 | B1 | 6/2002 | Richton | 455/456 |
| 6,411,891 | B1 | 6/2002 | Jones | 701/201 |
| 6,415,207 | B1 | 7/2002 | Jones | 701/1 |
| 6,486,801 | B1 | 11/2002 | Jones | 340/994 |
| 6,492,912 | B1 | 12/2002 | Jones | |
| 6,510,383 | B1 | 1/2003 | Jones | |
| 6,618,668 | B1 | 9/2003 | Laird | 701/200 |
| 2002/0016171 | A1 | 2/2002 | Doganata et al. | 455/456 |
| 2002/0069017 | A1 | 6/2002 | Schmier et al. | 701/213 |
| 2002/0070882 | A1 | 6/2002 | Jones | |
| 2002/0082770 | A1 | 6/2002 | Jones | |
| 2002/0099500 | A1 | 7/2002 | Schmier et al. | 701/200 |
| 2003/0098802 | A1 | 5/2003 | Jones | 340/994 |

FOREIGN PATENT DOCUMENTS

| | | |
|---|---|---|
| FR | 2 559 930 | 8/1985 |
| FR | 2674355 | 9/1992 |
| GB | WO 93/13510 A1 | 7/1993 |
| JP | 52066175 | 6/1977 |
| JP | 63288400 | 11/1988 |
| JP | 11034872 A | 2/1999 |
| WO | WO 90/01236 | 2/1990 |
| WO | WO 93/13503 | 7/1993 |
| WO | WO 94/02922 | 2/1994 |
| WO | WO 94/27264 | 11/1994 |
| WO | WO 96/04634 | 2/1996 |
| WO | WO 96/16386 | 5/1996 |
| WO | WO 98/07128 | 2/1998 |
| WO | WO 98/08206 | 2/1998 |
| WO | WO 98/14926 | 4/1998 |
| WO | WO 98/40837 | 9/1998 |

OTHER PUBLICATIONS

Brynielsson, Thore, Step by Step Development Towards Attractive Public Transport, Chalmers University of Technology, Gotebord, Sweden, Department of Transportation, 1976.

"Public Transportation Information and Management Ssytems", IEE Coloquium, Computing and Control Division, May 25, 1993, pp. 9/1–9/4, 12/1–12/2, 7/1–7/3.

"Vehicle Location and Fleet Management Systems", IEE Colloquium, Computing and Control Division, Jun. 8, 1993.

The 3rd International Conference on Vehicle Navigation & Information Systems, (VNIS) Norway, Sep. 2–4, 1992, pp. 312–315.

Preiss, George; Jenson, Lillian; "The Satref and GPS Information Projects", 1992 IEEE—3rd International Conference on Vehicle Navigation Information Systems, pp. 648–655.

"Vehicle Navigation & Information Systems Conference Proceedings" (P–253), Society of Automotive Engineers, Inc., Oct. 1991, pp. 789–796.

"1992 Compendium of Technical Papers", Institute of Transportation Engineers—INRAD: A Deminostration of Two–Way Roadway to Vehicle Communication for use in Traffic Operations, Annual Meeting, Washington, D.C. pp. 214–218.

"Paving the Way for GPS in Vehicle Tracking", Showcase World, Dec. 1992.

"Advance Vehicle Monitoring and Communication Systems for Bus Transit", Federal Transit Administration, Sep. 1991, Revised Mar. 1993.

Koncz, et al., "GIS–Based Transit Information Bolsters Travel Options", GIS World, Jul. 1995, pp. 62–64.

Helleker, Jan, "Real–Time Traveller Information—in everyone's pocket?"—a pilot test using hand portable GSM terminals, IEEE–IEE Vehicle Navigation & Information Systems Conference, Ottawa, VNIS 1993, pp. 49–52.

Burgener, E.C., et al., "A Personal Transit Arrival Time Receiver", IEEE—IEE Vehicle Navigation & Information Systems Conference, Ottawa, VNIS 1993, pp. 54–55.

Peng, Zhong–Ren, "A Methodology for Design for a GIS–Based Automatic Transit Traveler Information System", Computer, Environment and Urban Systems, vol. 21, No. 5, pp. 359–372, 1997.

Lessard, Robert, "The Use of Computer for Urban Transit Operations", IEEE—IEE Vehicle Navigation & Information systems Conference, Ottawa, VNIS 1993, pp. 586–590.

Sommerville, Fraser, et al., "Reliable Information in Everyone's Pocket—a Pilot Test", IEEE, vol. 1927, Mar. 1994, pp. 425–428.

"PROMISE—Personal Mobile Traveller and Traffic Information Service—Specification of Promise Services, Ver. 7", Telematics Application Programme A2, Transport, Jul. 1, 1996.

"PROMISE—Personal Mobile Traveller and Traffic Information Service—Generic Promise System Architecture, Ver. 2", Telematics Application Programme A2, Transport, Sep. 10, 1996.

"PROMISE—Personal Mobile Traveller and Traffic Information Service—Summary of Promise Public Relation Activities, Ver. 1", Telematics Application Programme A2, Transport, Feb. 12, 1999.

"PROMISE—Personal Mobile Traveller and Traffic Information Service—Abstract", The Institution of Electrical Engineers, 1997.

Sommerville, Fraser, et al., "The Promise of Increased Patronage", The Institution of Electrical Engineers, 1993, pp. 3/1–3/4.

"Automatic Transit Location System", Washington State Department of Transportation, Final Report, Feb. 1996.

"Advanced Traveler Aid Systems for Public Transportation", Federal Transit Administration, Sep. 1994.

"Advanced Vehicle Monitoring and Communication Systems for Bus Transit: Benefits and Economic Feasibility", U.S. Department of Transportation, Urban Mass Transportation Administration, Sep. 1991.

Leong, Robert, et al., "An Unconventional Approach to Automatic Vehicle Location and Control for Urban Transit", IEEE 1989, pp. 219–223.

"1994 Vehicle Navigation & Information Systems Conference Proceedings", Yokahama, Japan, Aug. 31–Sep. 2, 1994, pp. 807–810.

"Vehicle Navigation & Information Systems Conference Proceedings—P–253, Part 2", Society of Automotive Engineers, Inc., Oct. 1991.
Vehicle Navigation & Information Systems—Conference Record of Papers presented at the 3rd Vehicle Navigation & Information Systems Conference 1992., Reso Hotel, Osio Plaza., pp. 49–52.
Nelson, J. Richard, "Experiences Gained in Implementing an Economical Universal Motorist System", IEEE–IEE Vehicle Navigation & Information Systems Conference, Ottawa, VNIS 1993, pp. 67–71.
"The Cassiope/Eurobus Approach", IEEE–IEE Vehicle Navigation & Information Systems Conference, Ottawa, VNIS 1993, pp. 79–81.
Kihl, Mary, "Advanced Vehicle Location System for Paratransit in Iowa", IEEE–IEE Vehicle Navigation & Information Systems Conference, Ottawa, VNIS 1993, pp. 381–384.
Gault, Helen, et al., "Automatic Vehicle Location and Control at OC Transpo", IEEE–IEE Vehicle Navigation & Information Systems Conference, Ottawa, VNIS 1993, pp. 596–600.
Vehicle navigation & Information System—Conference Record of Papers presented at the First Vehicle Navigation and Information Systems Conference (VNIS '89), Sep. 11–13, 1999, pp. 602–605.
Heti, Gabriel, "Travelguide: Ontario's Route Guidance System Demonstration", IEEE–IEE Vehicle Navigation & Information Systems Conference, Ottawa, VNIS 1993, pp. A13–A18.
Jeffery, D.J., et al., "Advanced Traveller Information Systems in the UK: Experience from the Pleiades and Romanse Projects", IEEE–IEE Vehicle Navigation & Information Systems Conference, Ottawa, VNIS 1993, pp. 309–313.
Sweeney, Lawrence, E., et al., "Travinfo: A Progress Report, 1994 Vehicle Navigation & Information Systems Conference Proceedings", Yokahama, Japan, Aug. 31–Sep. 2, 1994, pp. 315–320.
Shimamura, Yta, et al., "Combined Position Detection System for Pedestrian/Train Mode", 1994 Vehicle Navigation & Information Systems Conference Proceedings, Yokahama, Japan, Aug. 31–Sep. 2, 1994, pp. 603–606.
Zavoli, Walt, "Customer Location Services", 1994 Vehicle Navigation & Information Systems Conference Proceedings, Yokahama, Japan, Aug. 31–Sep. 2, 1994, pp.613–617.
Tanaka, Yoshimi, et al., Automatic Traffic Information Provision System Utilizing Facsimile and Telephone (Now Operating in Osaka), 1994 Vehicle Navigation & Information Systems Conference Proceedings , Yokahama, Japan, Aug. 31–Sep. 2, 1994, pp. 627–632.
McDonald, Mike, et al., "Romanse (Road Management System for Europe) Project", 1994 Vehicle Navigation & Information Systems Conference Proceedings , Yokahama, Japan, Aug. 31–Sep. 2, 1994, pp. A–11–A–14.
Scott III, Robert H., "Computer–Aided Dispatch,", 1998, pp. 46–50.
Moore, Rodney J., "Hold the Phone!", American Demographics, Ithaca, Jan./Feb. 1996,.p. 68.
Delong, Jr., Edgar S., "Making 911 even better", Telephony, Dec. 14, 1987, pp. 60–63.
Bruzek, Frank J., "Class Calling Service—A Consumer Service Perspective", Globecom '85 IEEE Global Telecommunications Conference, Dec. 2–5, 1985, vol. 1 of 3, pp. 11.4.1–11.4.4
Powell, R., et al., "Real Time Passenger Information System for the Romanse Project", Colloouin Digest—IEE, Boston, Sep. 1993, pp. 9/1–9/3.
Huber, Paul, "Public Transport Information Systems in Munich", Intelligent Transport Systems World Congress '95—Second Wold Congress on Intelligent Transport Systems, Yokohama, Japan., Nov. 9–11. 1995, pp. 2362–2366.
Ronez, Nicholas, et al, "GIS–Based Transit Information Bolsters Travel Options", GIS World, vol. 6, part 7, Jun. 1995, pp. 62–64.
Catling, Ian, et al., "TABASCO—Improving Transport Systems in Europe", Pacific Rim TransTech Conference, Jul. 30–Aug. 2, 1995, 995 Vehicle Navigation & Information Systems Conference Proceedings, Washington State Convention and Trade Center, Seattle, Washington, USA, pp. 503–507.
Dailey, D.J., "Demonstration of an Advance Public Transportation System in the Context of an IVHS Regional Architecture", Proceedings of the First World Congress on Applications of Transport Telematics and Intelligent Vehicle–Highway Systems, Nov. 30, Dec. 3, 1994, Paris, France, pp. 3024–3031.
Hubner, Paul, "Advance Public Transportation Information in Munich", International Conference on Public Transport Electronic Systems, Conference Publication No. 42, Jun. 1996.
Thompson, S.M., et al., "Exploiting Telecommunications to Delivery Real Time Transport Information", Road Transport Information and Control, Apr. 21–23, 1998, pp. 59–63, Conference Publication No. 454 IEE 1998.
Kaminitzer, David, et al., Driver Information Systems: Influencing your Route, IEE Seminar, Mar. 3, 1999, pp. 5/1–5/5.
"Board Cites ATC in Spokane Near Miss", Article in Aviation Week & Space Technology, Mar. 28, 1977, URL: http://www.aviationnow.com.
Shifrin, Carole A., "Gate Assignment Expert System Reduces Delays at United's Hubs", Article in Aviation Week & Space Technology, Jan. 25, 1988.
"United Airlines applies TI's advance technologies to improve gate management at major airports", Article in Business Wire, Inc., Nov. 19, 1987.
Musich, Paula, "Airline Designs Software to move planes, people: Unite Airline's use of Covia Corp.'s Open Systems Manager, Connectivity Section", Article in PC Week, Jun. 7, 1988, vol. 5, No. 23, p. C11.
Stoll, Marilyn, "Systems help Airlines Manage Gate Schedules; Connectivity Supplement", PC Week, Jul. 25, 1988, vol. 5, No. 30, p. C4.
Reddy, Shyamala, "Traveling LAN: United Airlines Networks Its Terminals", Article in The Local Area Network Magazine, Jan. 1990, vol. 5, No. 1, p. 108.
Fisher, Sharon, "Networked Airport Systems help Travelers find their way; United Airlines subsidiary Covia Corp. devices integrated network.", Article in Software Magazine, Mar. 15, 1990, vol. 10, No. 4, p. 31.
Henderson, Danna K., "Automation Takes aim at airports: the power of the networked PC is being unleashed on passenger handling and ramp activities worldwide.", Article in Air Transport Wold, Aug. 1990., vol., 27, No. 8, p. 52.
"United Airlines introduces United Cargo Plug I, a new cargo computer system to serve freight forwarders", Business Wire, Oct. 22, 1990.

Miller, Barry, "Special Report: Airline Equipment, Service Center", Aviation Week & Space Technology, Aug. 25, 1975, p. 51.
Lyon, Mark, W., "Cargo Net Debate Splits Industry", Journal of Commerce, Specials, p. 4, Jul. 27, 1992.
Davies, I.L., et al., "Electronics and the Aeroplane", Proceedings of the Institution of Electrical Engineers, Paper No. 7604, delivered before the IEE Electronics Division, 29th Oct. 1975.
"Global Niche", Flight International, Sep. 26, 1990.
"Real–Time Briefings", Aviation Week and Space Technology, Oct. 13, 1986.
Flanagan, Mike, et al., "Amelia Earhart—Mystery Still Clouds Soaring Achievements", Chicago Tribune, Jul. 5, 1987, Final Edition, p. 5, Tempo Woman.
"Official Airline Guides", Airports®, Nov. 20, 1990, Around Airports, vol. 7, No. 47, p. 485.
"Automation System Gains Acceptance", Aviation Week & Space Technology, Nov. 23, 1992, vol. 137, No. 21, p. 97.
Klass, Philip, "French Testing "Ground–Derived' MLS"", Aviation & Space Technology, Avionics, p. 56, Dec. 15, 1975.
"Forecast Realized for ATC System", Aviation & Space Technology, Mar. 17, 1975, Avionics, p. 168.
Henderson, Danna, et al., "Ionworks: America West Automates New Phoenix Terminal Fully Integrated System to Handle Customer–Service Demands (America West Airlines Inc) (Includes Related Article Automation of passenger Service at Airports)", Airport Transport World, May 1, 1991. vol. 62.
3 Pages from a web site search under http://mit.edu/afs/net.mit/edu/project/attic/usa–today/tech/37, Jun. 12, 2003.
"What's New in Passenger Handling Euqipment", Air Transport World, vol. 24, p. 62, Sep. 1987.
"Senator Urges Acceleration of Navstar", Aviation & Space Technology, Avionics, p. 153, Oct. 3, 1983.
"AFSC Broadens Joint Program Efforts", Aviation & Space Technology, System Acquisition, p. 83, Jul. 19, 1976.
Herskovitz, Don, "GPS Insurance Antijamming the System; Brief Article", Journal of Electronic Defense, Dec. 1, 2000, No. 12, vol. 23, p. 41.
Hambly, Richard M., et al., "Aircraft Traffic Management on the Airport Surface Using VHF Data Link for CNS", IEEE AES Systems Magazine, Mar. 1995, pp. 9–13.
Berzins, G., et al., "INMARSAT: Worldwide Mobile Satellite Services on Seas, in Air and on Land", Space Technology, vol. 10, No. 4, pp. 231–237, 1990.
Jenney, L.L., et al., "Man as Manager of Automated Resources in an Advanced Air Traffic System", J. Aircraft, vol. 12, No. 12, Dec. 1975.
"Routing & Scheduling System improvements from RTSI; Routing Technology Software, Inc.; Product Announcement", Modern Brewery Age, vol. 43, No. 3, p. 11S, Jan. 20, 1992.
Yanacek, Frank, "Hitching to the stars; satellites for shipment tracking", Research Information Transportation Journals, Combined, No. 6, vol. 29, p. 16.
Stoll, Marilyn, "For on–the–road firms, hand–held terminals are pivotal. Connectivity", Research Information Transportation Journals, Combined, No. 34, vol. 5, p. C11.
"IBM and Hunt to Market New Truck Tracker; International Business Machines", J.B. Hunt Transport Services; Brief Article, No. 210, vol. 101, p. 4.
Klass, Philip J., "Two Carriers Plan Automatic Data Link", Aviation Week and Space Technology, Air Transport Section, May 23, 2997, p. 36.
"Data Link Evolved Over Three Decades", Aviation Week and Space Technology, Air Transport Section, May 23, 1977, p. 36.
Klass, Philip J., "American to Install Printers in Cockpits", Aviation Week and Space Technology, Avionics, Jul. 21, 1980, p. 56.
Lefer, Henry, "Computers on a boon to E&M, but at a price", Air Transport World, vol. 23, p. 53, Feb., 1986.
Donaghue, J.A., "Choice of Data Link Systems Expands as New Generation Hits the Market", Air Transport World, vol. 20, p. 58, Apr. 1983.
Klass, Philip J., "Digital Network Could Improve Aircraft Links to Operations, ATC", Aviation Week and Space Technology, International Air Transport Section, vol. 131, No. 21, p. 121, Nov. 20, 1989.
Board Cites ATC in Spokane Near Miss, Article in Aviation Week & Space Technology, Safety Section, Mar. 28, 1977, p. 59.
"Vicorp Interactive Systems", Aviation Daily, Aviation Suppliers Section, vol. 309, No. 17, p. 147.
Neumann, Dr. Horst, "ATC Concepts with Extensive Utilization of Automatic Data Processing", pp. 4–1 to 4–9; No Publication Information or Date Information Provided.
Maxwell, Robert L., "Automation Possibilities in Air Traffic Control", pp. 561–563, No Publication Information or Date Information Available.
"History of GPS", 3 pages, No Publication Information or Date Information Available.
"Road Transport Research—Intelligent Vehicle High Systems—Review of Field Trials", prepared by An OECD Scientific Expert Group, pp. 1–101, Organisation for Economic Co–Operation and Development—No Date Information Available.
Ratcliff, Robert, et al., Transportation Resources Information Processing System (TRIPS), pp. 109–113, No Publication Information or Date Information Available.
Balke, Kevin,, et al., Collection and Dissemination of Real–Time Travel Time and Incident Information with In–Vehicle Communication Technolgies, pp. 77–82, No Publication Information or Date Information Available.

* cited by examiner

NOTIFICATION SYSTEM AND METHOD THAT INFORMS A PARTY OF VEHICLE DELAY

This application is a continuation of application No. 09/992,817, filed Nov. 6, 2001, now U.S. Pat. No. 6,700,507, which is a continuation of application No. 09/233,795, filed Jan. 19, 1999, now U.S. Pat. No. 6,313,760, which is a continuation of the application No. 08/407,319, filed Mar. 20, 1995, now abandoned, which is a continuation-in-part of application No. 08/063,533, filed May 18, 1993, now U.S. Pat. No. 5,400,020.

Each of the aforementioned patents and patent applications is incorporated herein by reference.

FIELD OF THE INVENTION

The present invention generally relates to data communications and information systems and, more particularly, to advance notification systems and methods for notifying users in advance of the impending arrival of a vehicle or user, for example but not limited to, a bus, train, delivery van, plane, fishing vessel, or other vessel at a particular vehicle stop.

BACKGROUND OF THE INVENTION

There are many situations when it is desirable for people to know of the approximate arrival time of a particular transportation vehicle shortly before the vehicle is to arrive at a particular destination. For example, a person having to pick up a friend or relative at a commercial bus station either has to call the bus station to find out the approximate arrival time (information which is oftentimes unavailable) or plan on arriving at the bus station prior to the scheduled arrival time of the bus and hope the bus is not delayed.

Another example is in the commercial fishing industry, wherein fish markets, restaurants, and other establishments desire to purchase fish immediately upon arrival of a commercial fishing boat at a port. Currently, such establishments, in order to ensure being able to purchase the freshest catch often depend on predetermined schedules of fishing fleets, which are not always accurate or reliable.

Still another example involves school children that ride school buses. School children who ride buses to school often have to wait at their bus stops for extended lengths of time because school buses arrive at particular bus stops at substantially different times from one day to the next. The reason is that school buses are not always the best-maintained vehicles on the roads, frequently operate during rush hour traffic, and must contend with congested urban/suburban conditions. As a result, school children are forced to wait at their bus stops for long periods of time, oftentimes in adverse weather conditions, on unlit street comers, or in hazardous conditions near busy or secluded streets. If it is raining, snowing, windy and cold, and/or even dark, such conditions can be unhealthy and unsafe for children.

Thus, generally, it would be desirable for a user to know when a vehicle (such as a bus, truck, train, plane, or the like) is (a) a particular time period (for example, number of minutes or seconds) away from arriving at a destination, (b) a particular distance (for example, number of miles or height) away from the destination, or (c) at a particular location among a set of location points, so that the user can adjust his/her schedule and avoid arriving too early or too late.

In the past, in order to combat the arrival time problem in the context of school buses, student notification systems have been employed that use a transmitter on each bus and a receiver inside each student home. U.S. Pat. No. 4,713,661 to Boone et al. and U.S. Pat. No. 4,350,969 describe systems of this type. When the school bus and its on-board transmitter come within range of a particular home receiver, the transmitter sends a signal to notify the student that his/her school bus is nearby. While such notification systems work satisfactorily under certain circumstances, nevertheless, these systems are limited by the range of the transmitters and require the purchase of relatively expensive receivers for each student. In addition, such systems provide little flexibility for providing additional information to the students, such as notifying them of the delayed arrival of a bus, alternative bus route information, or information regarding important school events.

SUMMARY OF THE INVENTION

An object of the present invention is to overcome the deficiencies and inadequacies of the prior art as noted above and as generally known in the industry.

Another object of the present invention is to provide an advance notification system and method for according advance notification of the impending arrival of a vehicle at a particular vehicle stop.

Another object of the present invention is to provide an advance notification system and method for according advance notification to school students of the impending arrival of a school bus at a particular vehicle stop.

Another object of the present invention is to provide an advance notification system and method for inexpensively according advance notification of the impending arrival of a vehicle at a particular vehicle stop.

Another object of the present invention is to provide an advance notification system that is reliable in operation and flexible in design to permit customization to a particular application.

Briefly described, the present invention is an advance notification system for notifying passengers of an impending arrival of a vehicle as the vehicle progresses along a scheduled route with particular stop locations and corresponding scheduled times of arrival at the stop locations. The advance notification system generally comprises a vehicle control unit (VCU) disposed on each vehicle and a base station control unit (BSCU) which is configured to communicate with all of the vehicle control units and with passenger telephones.

The VCU includes a vehicle control mechanism, a vehicle communication mechanism controlled by the vehicle control mechanism, a vehicle clock for tracking elapsed time of the vehicle while on the scheduled route to determine when the vehicle is early, late, and on time along the scheduled route, optional input switches (e.g., start/reset, advance stop number, move stop number back) that can be operated by the vehicle driver to indicate when the vehicle has reached particular stops along the route, and optional sensors (e.g., positioning system input, etc.) for signaling to the vehicle control mechanism when the vehicle is early, late, and on time along the scheduled route. The control mechanism is adapted to initiate calls utilizing the vehicle communication mechanism when the elapsed time and/or traveled distance of the vehicle at any of the particular positions is either ahead or behind the scheduled time and/or distance. In the preferred embodiment, the vehicle communication mechanism is a wireless communication interface, such as a mobile telephone, radio frequency (RF) transceiver, or other suitable device.

The BSCU has a base station communication mechanism and a base station control mechanism for controlling the base station communication mechanism. The base station communication mechanism receives the call from the VCU and receives the amount of time and/or distance in which the vehicle is ahead or behind relative to the schedule. The base station control mechanism causes calls to be made to each of the passengers to be boarded at a particular stop location via the base station communication mechanism prior to the arrival of the vehicle at the particular stop location. In the preferred embodiment, the base station communication mechanism is a wireless communication device, such as a mobile telephone or RF transceiver (includes both transmitter and receiver), for communicating with the vehicle communication mechanism and also comprises at least one telephone for calling passenger telephones.

In accordance with a significant feature of the present invention, the telephone call to advise a passenger of the impending arrival of the vehicle preferably can exhibit a distinctive telephone ring sound so that the call recipient need not answer the telephone in order to receive the message. Moreover, the distinctive telephone ring sound can be coded by any sequence and duration of rings and/or silent periods.

It should be emphasized that while the present invention is particularly suited for application to school buses, there are many other applications. As examples, the advance notification system and method of the present invention could be employed with commercial buses, trains, planes, pickup vehicles, delivery vehicles, fishing vessels, and numerous other transportation vehicles.

Other objects, features, and advantages of the present invention will become apparent from the following specification, when read in conjunction with the accompanying drawings. All such additional objects, features, and advantages are intended to be included herein.

BRIEF DESCRIPTION OF THE DRAWINGS

The present invention can be better understood with reference to the following drawings. The drawings are not necessarily to scale, emphasis instead being placed upon clearly illustrating the principles of the present invention. Moreover, like reference numerals designate corresponding parts throughout the several views.

DETAILED DESCRIPTION OF THE PREFERRED EMBODIMENTS

The features and principles of the present invention will now be described relative to preferred embodiments thereof. It will be apparent to those skilled in the art that numerous variations or modifications may be made to the preferred embodiments without departing from the spirit and scope of the present invention. Thus, such variations and modifications are intended to be included herein within the scope of the present invention, as set forth and defined in the claims.

I. System Architecture

Figure 1:
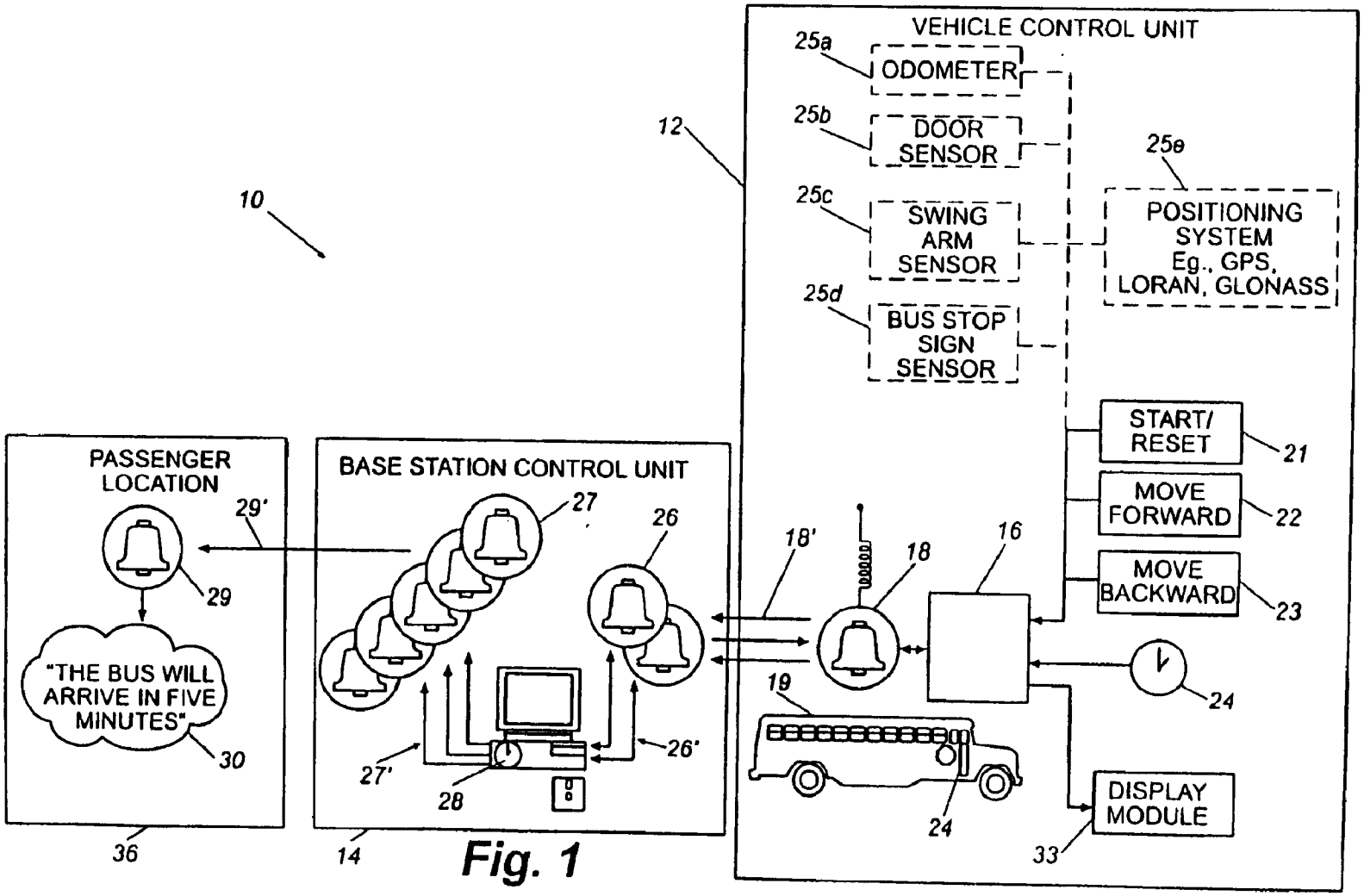
FIG. 1 is a high level schematic diagram of an advance notification system of the present invention as applied to a school bus system, as an example, the advance notification system generally comprising vehicle control units (VCU) in communication with a base station control unit (BSCU), which is in turn in communication with passenger telephones.

Referring now in more detail to the drawings, wherein like reference numerals designate corresponding parts throughout the several views; FIG. 1 is a schematic diagram of the advance notification system 10 of the present invention, as configured to operate for example, but not limited to, a school bus system.

The advance notification system 10 includes, preferably, a plurality of on-board vehicle control units (VCU) 12, a single base station control unit (BSCU) 14, and a plurality of passenger telephones 29. As configured in the school bus system 10, a VCU 12 is installed in each of a plurality of school buses 19, all of which communicate with the single BSCU 14. Moreover, the BSCU 14 communicates with the telephones 29 at one or more passenger locations 36, or student homes in the present exemplary application.

A. Vehicle Control Unit

The VCU 12 will now be described with reference to FIGS. 1, 2, and 3. Referring first to FIG. 1, each VCU 12 includes a microprocessor controller 16, preferably a model MC68HC705C8P microprocessor controller that is manufactured by and commercially available from the Motorola Corporation, USA. The microprocessor controller 16 is electrically interfaced with a communication mechanism 18, preferably a wireless communication device, for enabling intercommunication of data with the BSCU 14. Examples of suitable wireless communication devices include a mobile telephone (e.g., cellular) and a transceiver (having both a transmitter and a receiver) operating at a suitable electromagnetic frequency range, perhaps the radio frequency (RF) range.

In the embodiment using a wireless RF transceiver as the communication mechanism 18, data can be sent in bursts in the form of in-band tones, commonly called "twinkle tones". These tone bursts can occur in the background of an existing voice channel. Twinkle tones are oftentimes used in transportation systems, such as taxicab communications systems.

Figure 5:
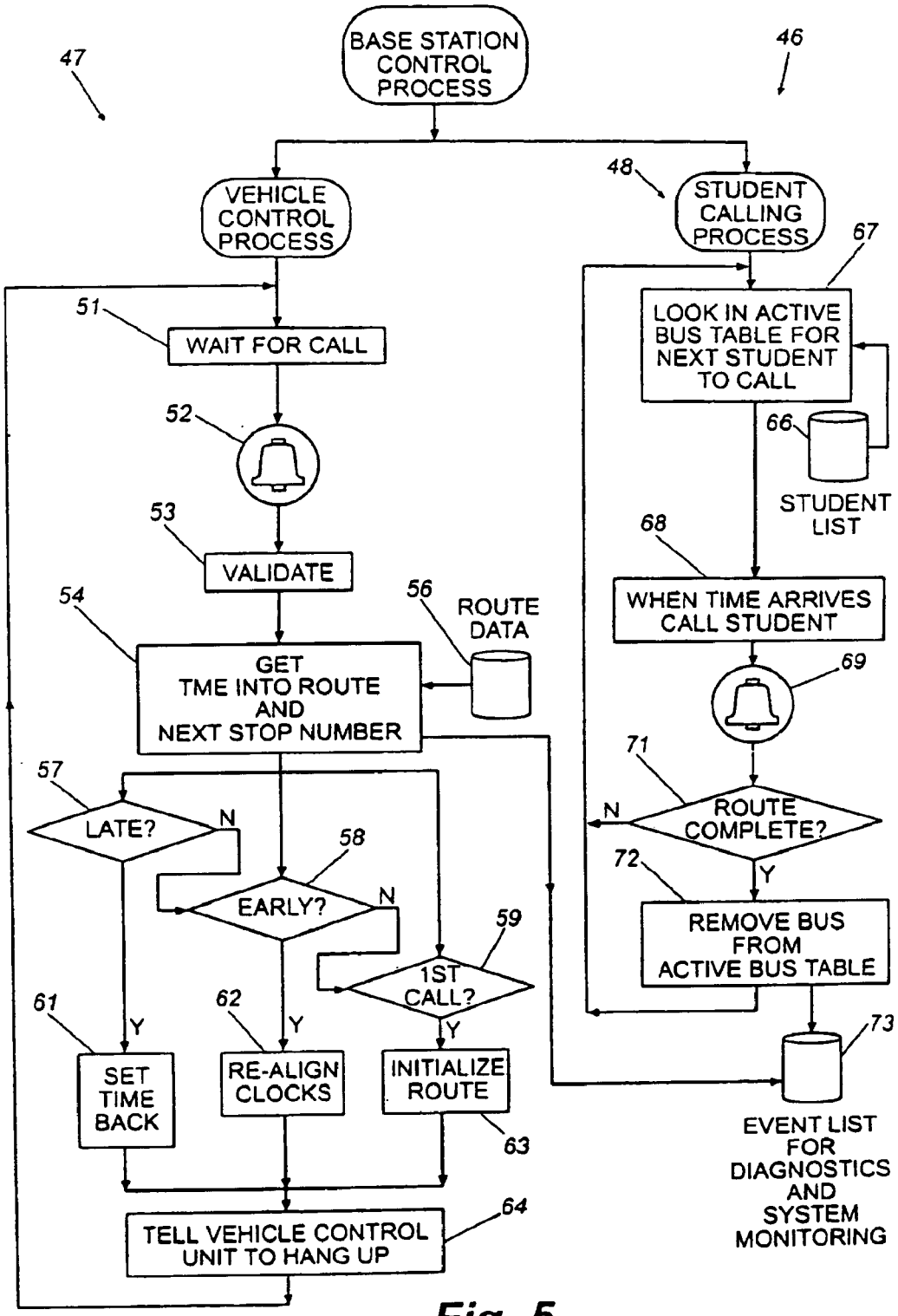
FIG. 5 is a flow chart of a base station control process for the base station control unit 14 of FIG. 1.

The microprocessor controller 16 is electrically interfaced with a start/reset switch 21, a move forward switch 22, a move backward switch 23, a clock 24, and optionally, sensors 25*a*–25*d*. Generally, vehicle tracking is accopmlished by monitoring the control switches 21–23, the sensors 25*a*–25*e*, the power to the controller 16, and a route database (FIG. 5). It is recommended that all of the foregoing features be employed to provide redundant checking.

More specifically, the start/reset switch 21 can be actuated by the bus driver upon starting along the bus's scheduled route to initialize the system 10. The move forward switch 22 can be actuated by the bus driver upon reaching a bus stop in order to inform the VCU 12 that a stop has been made, the details of which will be further described hereinafter. The move backward switch 23 can be actuated by the bus driver at a bus stop if the bus driver has erroneously toggled the move forward switch 22 too many times, as will be further described in detail hereinafter. This indicates to the microprocessor controller 16 that a display module 33 and memory must be updated. In essence, the move forward switch 22 and the move backward switch 23 cause the next stop designation which is displayed on the display module 33 and stored in the VCU 12 to toggle forward and backward, respectively.

The VCU 12 can be configured so that the operation of the start/reset switch 21, the move forward switch, and the move backward switch 23 are purely optional by the bus driver. In this configuration, the sensors 25*a*–25*e* automatically accomplish the aforementioned functions of the switches 21–23. However, in certain cases, the bus driver may want to use the switches to override the sensors 25*a*–25*e*. One of these cases may be when a student rides a bus only two out of five school days. Rather than program the VCU 12 to track these unnecessary stops, the driver may manually control the stop number by the switches 21–23.

The clock 24 tracks the elapsed time as the bus travels along its scheduled route and feeds the timing information to the microprocessor controller 16.

The display module 33 informs the bus driver as to the number corresponding to the next stop and the time (preferably, in seconds) necessary to reach the next stop. Other types of information may also be displayed on the display module 33. For example, the display module 33 may display the amount of time that the bus 19 is ahead of or behind schedule, the status of the VCU 12 in communication with the BSCU 14, or, upon actuation of the start button 21, that the advance notification system 10 is operating.

The optional sensors 25*a*–25*e* include an odometer sensor 25*a* for determining distance into a route. The sensor 25*a* can be connected to the bus drive shaft and counts revolutions. This data can be used to determine the stop number.

A door sensor 25*b* can be used to count the number of door operations (opening/closing) of the front door 24 of the school bus 19, which should correspond with the number of stops.

A swing arm sensor 25*c* can be implemented to count the number of times the arm operates. This operation should coincide with the number of stops.

A bus stop sign sensor 25*d* can be utilized to count the number of times the bus stop sign operates. This operation should coincide with the number of stops.

A positioning system 25*e* can be used to determine the geographical position of the bus 19 on the earth's surface. The positioning system 25*e* could be the GPS (global positioning system), the LORAN positioning system, the GLONASS positioning system (USSR version of GPS), or some other similar position tracking system.

Figure 2:
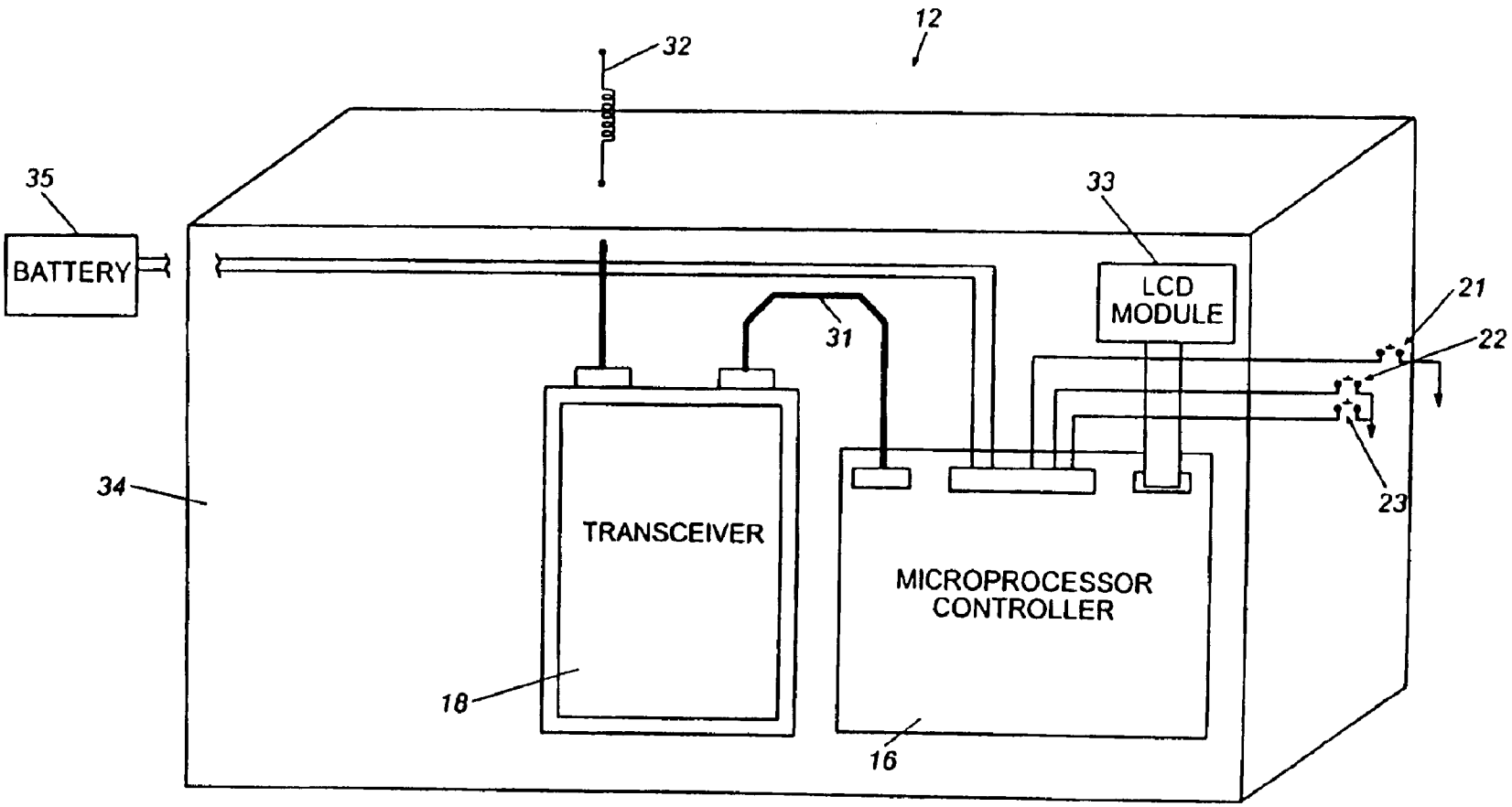
FIG. 2 is a high level schematic diagram of the VCU of the advance notification system of FIG. 1.

FIG. 2 is a high level schematic circuit diagram of the VCU 12. The VCU 12 is designed to be a compact unit with a generally rectangular housing 34 that is mounted preferably on or in front of the dashboard of the bus 19 in view and within reach of the bus driver. In the housing 34, the microprocessor controller 16 is interfaced with the transceiver 18 by a transceiver jack 31 (preferably a conventional 8-conductor telephone jack when transceiver 18 is a mobile telephone), and the transceiver 18 includes an antenna 32 for transmitting and receiving signals to and from the BSCU 14. Further, the VCU 12 includes a liquid crystal display (LCD) module 33 disposed for external viewing of the display by the bus driver for providing information to the bus driver, as described previously.

Figure 3:
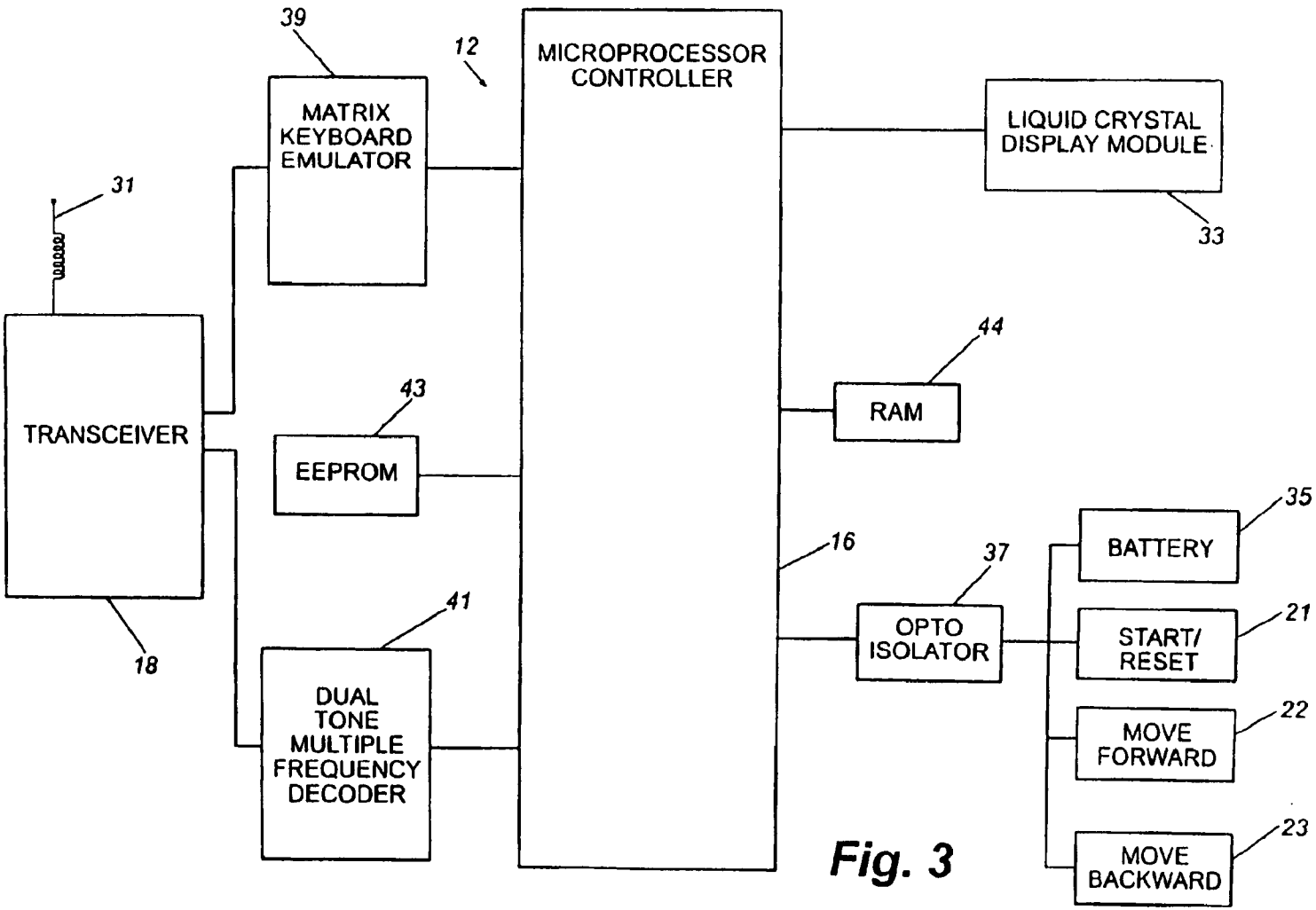
FIG. 3 is a low level block diagram of the VCU of FIGS. 1 and 2.

FIG. 3 is a more detailed schematic circuit diagram of the electronic components associated with the VCU 12. The microprocessor controller 16 essentially controls the operation of the transceiver 18 and the LCD display module 33. A switching element 37, such as an optical isolator (opto isolator) unit 37, provides a buffer between the microprocessor controller 16 and the battery 35 as well as switches 21, 22, 23. An EEPROM 43 is provided for storing the control programs (FIGS. 6 and 7) and other requisite data for the microprocessor controller 16, and a RAM 44 is provided for running the control programs in the microprocessor controller 16. A matrix keyboard emulator 39 is interfaced between the transceiver 18 and the microprocessor controller 16 for allowing the microprocessor controller to control and transmit signals over the transceiver 18. Further, a dual tone multiple frequency decoder 41 is interfaced between the mobile telephone 18 and the microprocessor controller 16 for decoding modem signals, or tones, received by the mobile telephone 18 from the BSCU 14.

B. Base Station Control Unit

The BCSU can be implemented by any conventional computer with suitable processing capabilities. The BCSU 14 can communicate to the homes of students via, for example but not limited to, any of the following interfaces: (a) dialing through multiple port voice cards to the passenger telephones 29; (b) communication using a high-speed switch-computer applications interface (SCAI) to a digital switch operated by a telephone utility company; the SCAI adheres to the conventional OSI model and supports the carrying of application information in an application independent fashion; and (c) communication using an analog display services interface (ADSI) maintained by a telephone utility company. ADSI is a cost effective technology that delivers voice and data information between a telephone terminal and a digital switch or server using existing copper telephone lines.

In the preferred embodiment, the BSCU 14 communicates through multiple port voice cards to passenger telephones 29. In this regard, a set of conventional voice processing cards are utilized for communicating with one or more student homes, as depicted in FIG. 1 as passenger locations 36. The system 10 could be configured to merely call prospective passengers, thus warning them of the impending arrival of a bus 19, as opposed to forwarding both a call and a message. In the preferred embodiment, the BSCU 14 includes at least one communication mechanism 26 and associated line 26', dedicated for communication with the VCUs 12. However, as mentioned previously, the BSCU 14 may be designed to communicate with the VCUs 12 via any suitable wireless communication device, in which case, the BSCU 14 would include a corresponding transceiver having the ability to receive a plurality of signals from the plurality of vehicles 19.

The BSCU 14 also includes at least one, but preferably a plurality of telephones 27 (or other suitable communication interface) with associated telephone lines 27', for making the telephone calls to the passenger locations 36, or in this case, the homes 36 of the students and allow the telephone to ring predefined number of times so that it is not necessary for the telephone to be answered in order for the telephone call to be recognized as that of the advance notification system 10.

The calling program (FIG. 7) associated with the advance notification system 10 can also be configured to make the passenger telephone 29 exhibit a distinctive telephone ring sound, or pattern, so that the call recipient need not answer the telephone in order to receive the message. The distinctive telephone ring can be coded by any sequence and duration of rings and/or silent periods. A standard ring signal that is sent to a telephone from the telephone utility company is typically a periodic electrical analog signal having a frequency of 20 Hz and a peak-to-peak voltage amplitude of −48 volts. The ring signal is asserted on the telephone connection 29' for a predefined time period for ringing the telephone. The foregoing time period can be manipulated in order to derive a distinctive sequence and duration of rings and/or silent periods.

Implementation of a distinctive telephone ring can be accomplished by purchasing this feature from a telephone utility company. This feature is widely available to the public. Generally, telephone utility companies operate network switches, now usually digital, that serve as interfaces for telephonic communications. A particular geographic region is typically allocated to a particular switch(s). In essence, one or more distinctive telephone rings can be driven by software running in the switches to a particular telephone. Examples of switches that a recommercially available to telephone utility companies are as follows: a model DMS 100 by Northern Telecom, Canada; a model 5ESS by AT&T, U.S.A.; and a model EWSD by Siemans Stromberg-Carlson Corp., Germany.

The feature for establishing the distinctive telephone ring is sold to the public under several different commercial trade names, depending upon the telephone utility company. Examples are as follows: Call Selector by Northern Telecom, Canada; Ringmaster by Bell South, U.S.A.; Smartlink by SNET, U.S.A.; Multi-ring by Ameritech, U.S.A.; Priority Ring by PacBell, U.S.A.; Priority Call by Cincinnati Bell, U.S.A.; and Ring Me by Standard Telephone Co., U.S.A.

Furthermore, in the case where a parent or a student answers the telephone call from the base station unit 14, a prerecorded message may be played by the BSCU 14. An example of such a message would be: "The bus will arrive in five minutes," as indicated in FIG. 1 at the reference numeral 30.

II. System Operation

A. Initialization

Initially, the bus schedule for each bus 19 is programmed into the advance notification system 10 by having the respective bus driver drive his respective bus one time along the corresponding scheduled bus route at the approximate speed the bus would usually travel on the route and with the bus driver making all the scheduled stops along the route and waiting at each stop for the approximate time it would take for all the students at that stop to board the bus 19. As the bus driver drives the bus 19 along the route for initialization purposes, the internal real time clock 24 runs and the bus driver actuates the switches 21, 22, 23 as required in accordance with the principles described previously. The timing information is recorded in the memory (RAM 44 and EEPROM 43) of the VCU 12.

The timing information which is recorded during the initialization of the system 10 is used as a reference during the usual operation of the system 10 for the purpose of determining whether a bus 19 is early or late at each of the bus stops. In the preferred embodiment, determining the status (i.e., early, on time, late) of a bus 19 is accomplished by comparing the time at which a bus 19 actually departs from a stop to the scheduled time of departure.

However, it should be emphasized that other methodologies could be utilized for determining whether the bus 19 is early or late at an instance in time. For example, the odometer 25*a* of the bus 19, as indicated by phantom lines in FIG. 1, could be monitored by the microprocessor controller 16. At particular times, the odometer mileage reading could be compared to reference odometer mileage readings which were obtained during the initialization of the system 10. In this way, the determination of whether a bus 19 is early or late can occur at any time during a bus route and can occur as many times as desired.

Another methodology which could be utilized for determining whether the bus 19 is early or late involves interfacing the VCU 12 with the positioning system 25*e*, as shown in FIG. 1 by phantom lines. From the geographical position data received from the positioning system 25*e*, the microprocessor controller 16 could determine where the bus 19 is situated on the earth at any given time. The bus location at a particular time could then be compared with scheduled locations and scheduled times in order to determine whether the bus 19 is early or late and by what amount.

B. Regular Operation

Figure 4A:
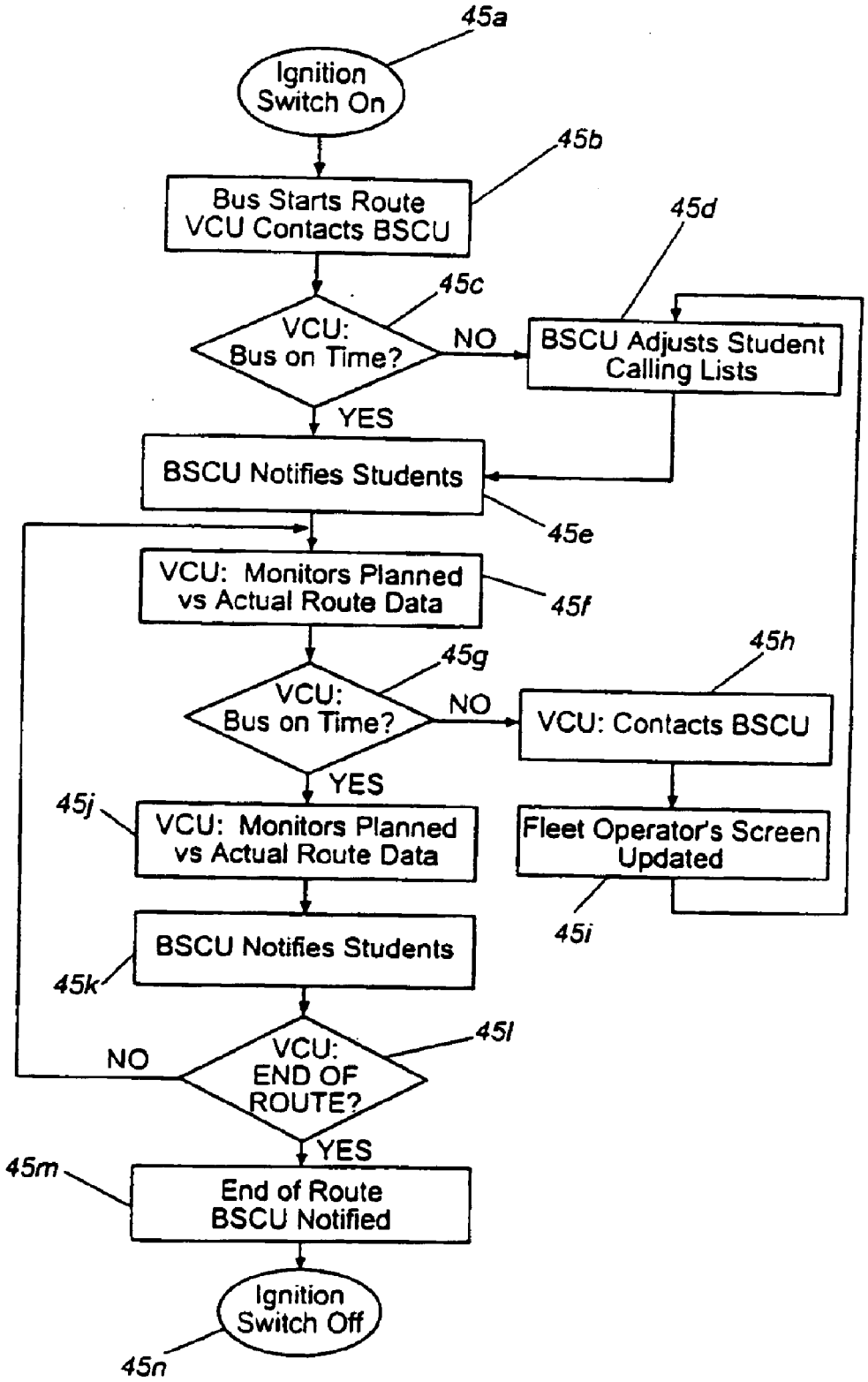
FIG. 4A is a flow chart of the overall operation of the advance notification system of FIG. 1.
Figure 4B:
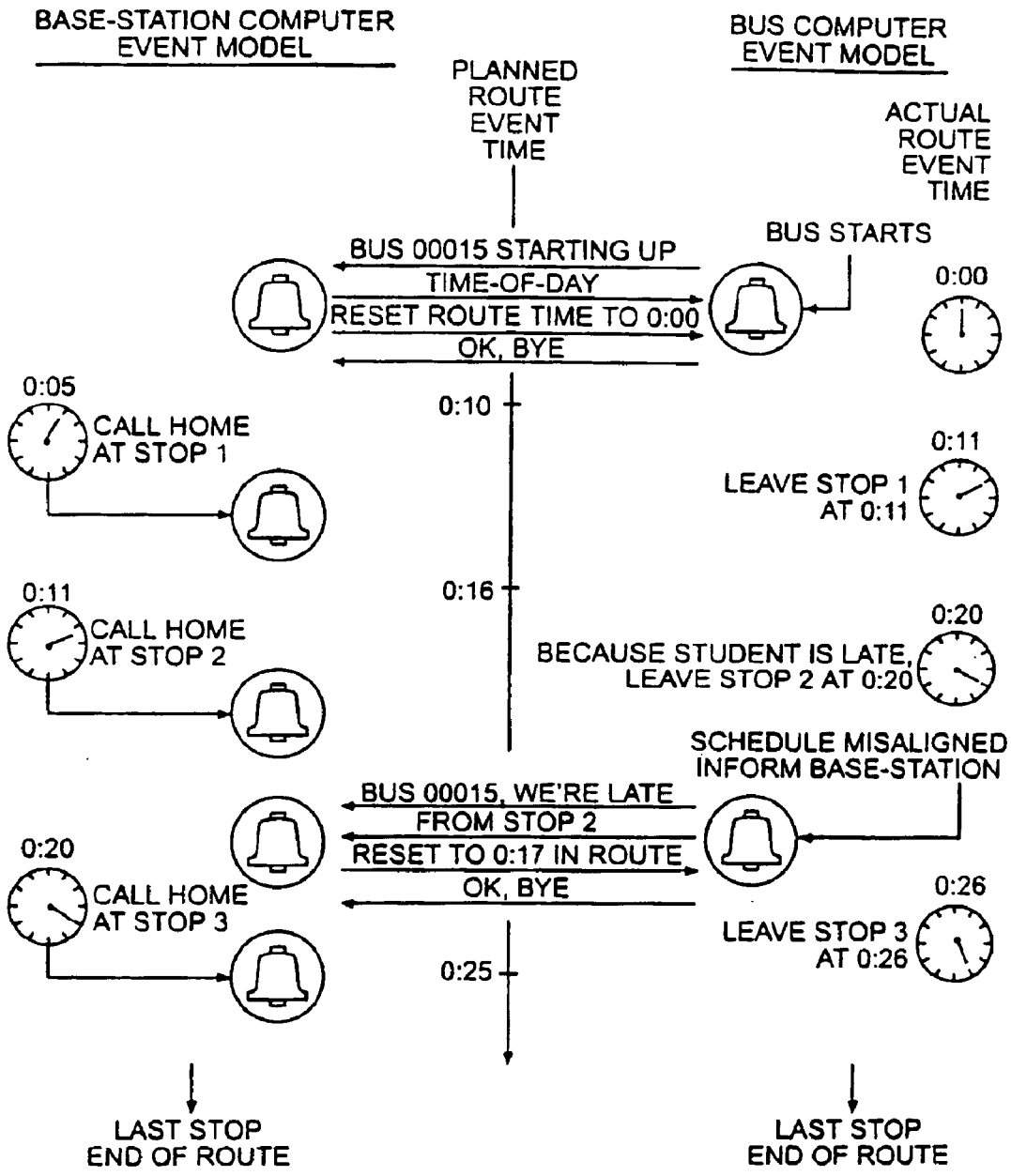
FIG. 4B is a an example of a schedule for a sequence of events illustrating the operation of the advance notification system of FIG. 1.

The overall operation of the advance notification system 10 will be described with reference to FIGS. 4A and 4B. FIG. 4A sets forth a flow chart showing the overall operation after the system 10 has been initialized. FIG. 4B shows an example of a schedule of possible events and the interactions which might occur between the VCU 12 and the BSCU 14 as the bus 19 travels along its scheduled route and makes its scheduled stops.

In FIG. 4B, the left hand column illustrates the sequence of events for the BSCU 14, and the right hand column illustrates the sequence of events on the VCU 12. Between the right and left hand columns is illustrated a time line for the scheduled bus stops. The time line has the following time designations: ten minutes, sixteen minutes, and twenty-two minutes, all along the scheduled bus route.

First, the bus ignition is switched on, as indicated in FIG. 4A at block 45*a*. At the beginning of the bus route, the system 10 could be configured to automatically initialize itself upon power up of the VCU 12, and further, the unit 12 could be programmed to make initial contact with the BSCU 14 after the bus 19 moves a predefined distance, such as ⅛ mile, as determined by the odometer sensor 25*a*. This initialization action causes the microprocessor controller 16 to telephone the BSCU 12 to inform the BSCU 12 that the bus 19 is beginning its route and to initialize the BSCU 14 relative to the VCU 12. The foregoing action is indicated at flow chart block 45*b* (FIG. 4A). Alternatively, the bus driver can press the start/reset switch 21 on the VCU 12 to initialize the VCU 12.

After initialization of the VCU 12, the display module 33 preferably displays "Stop Number 1" followed by the amount of time to reach stop number 1. The time continuously runs as the bus 19 progresses along the bus route.

Next, as indicated at flow chart block 45*c* (FIG. 4A), the VCU 12 determines, continuously or periodically, if the bus 19 is on time by analyzing the status of devices 21–25 (FIG. 1) in view of planned route data (derived from initialization). In the preferred embodiment, the VCU 12 at least compares its elapsed time from the clock 24 (FIG. 1) with its scheduled time from the planned route data. When the bus 19 is on time, the VCU 12 does not contact the BSCU 14, and the BSCU 14 commences calling students at the predefined time prior to arrival of the bus 19 at the particular bus stop, as indicated in flow chart block 45*e* (FIG. 4A). In the example of FIG. 4B, at five minutes along the scheduled route, the BSCU 14 places a telephone call to the homes 36 of the school children to be picked up at bus stop number 1.

However, when the VCU 12 determines that the bus 19 is early or late at this juncture, the VCU 12 contacts the BSCU 14, as indicated at flow chart block 45*d* (FIG. 4A), and the BSCU 14 adjusts its student calling lists accordingly so that the students are called in accordance with the predefined time notice, e.g., five minutes.

Further, as indicated at flow chart block 45*f* (FIG. 4A), the VCU 12 again determines, continuously or periodically, if the bus 19 is on time by analyzing the devices 21–25 (FIG.

1). Preferably, in this regard, the VCU 12 at least compares its elapsed time with its scheduled time.

Back to the example of FIG. 4B, at ten minutes along the schedule, the bus 19 arrives at the bus stop number 1 and takes one minute to load all the students at this stop onto the bus 19. Just prior to leaving stop 1, the bus driver actuates the move forward switch 22. Upon actuating the move forward switch 22, the display module 33 preferably displays "Stop Number 2" followed by the amount of time to reach stop number 2. The foregoing feedback signal may be generated by one of the sensors 25*a*–25*e* so that the bus driver need not actuate the move forward switch 22.

In accordance with flow chart block 45*f* (FIG. 4A), the microprocessor controller 16 checks the elapsed time of eleven minutes to confirm that such time corresponds to the programmed time for bus stop number 1. It will determine whether the bus 19 is early or late. If the bus 19 is either early or late, the VCU 12 will call the BSCU 14 to inform the unit 14 of this fact, as indicated at flow chart blocks 45*g* and 45*h* (FIG. 4A). If the bus 19 is on time, then the VCU 12 will continue to monitor the inputs from devices 21–25, as indicated in flow chart block 45*j*. In the example of FIG. 4B, it is assumed that the bus 19 is neither early nor late in leaving bus stop number 1.

Because the bus 19 is scheduled to arrive at bus stop number 2 at sixteen minutes along the route, at eleven minutes along the route the BSCU 14 places telephone calls to the homes 36 of the school children who board the bus 19 at bus stop number 2, as indicated at flow chart block 45*k* (FIG. 4A).

The bus 19 then arrives at bus stop number 2 and commences the boarding of students. However, because one of the school children is running late that particular morning, the bus 19 spends three minutes at bus stop number 2, and, thus, gets three minutes behind schedule. Thus, the bus departs at twenty minutes along the route.

At this time, the VCU 12 makes an inquiry as to whether there are any more bus stops, as indicated in flow chart block 45*l*. If so, then the VCU 12 again monitors its travel status by checking devices 21–25 (FIG. 1), in accordance with flow chart block 45*f* (FIG. 4A). If not, then the VCU 12 notifies the BSCU 14 of the end of the route, as indicated at flow chart block 45*m*.

In the example of FIG. 4B, upon receiving the information that the bus 19 is late, the microprocessor controller 16 compares the departure time to the scheduled departure time of seventeen minutes, pursuant to flow chart block 45*f* (FIG. 4A), and determines that the bus 19 is three minutes behind schedule, in accordance with flow chart blocks 45*g* (FIG. 4A). The microprocessor controller 16 then telephones the BSCU 14 to inform the BSCU 14 that the bus 19 is three minutes behind schedule, as indicated in flow chart block 45*h* (FIG. 4A). A fleet operator's screen associated with the BSCU 14 is updated to reflect the status of the late bus 19, as indicated at flow chart block 45*i* (FIG. 4A). Moreover, as indicated at flow chart block 45*d* (FIG. 4A), the BSCU 14 then reschedules the telephone calls that are to be made to the parents of the students at bus stop number 3 from twenty-two minutes along the route to twenty-five minutes along the route and resets the VCU 12 to seventeen minutes along the route, the scheduled time for the bus to leave bus stop number 2.

At twenty minutes along the route, the BSCU 14 calls the student homes 36 of the students corresponding to bus stop number 3, in accordance with flow chart block 45*k* (FIG. 4A), to inform them that the bus 19 is five minutes from arriving. At twenty-five minutes along the route, the bus 19 arrives at bus stop 3, takes one minute to load the students on to the bus 19 and then proceeds onto the school.

At this time, the VCU 12 makes an inquiry as to whether there are any more bus stops, as indicated in flow chart block 45*l*. In the example of FIG. 4B, there are no more stops and, accordingly, the VCU 12 notifies the BSCU 14 of the end of the route, as indicated at flow chart block 45*m*.

Finally, worth noting is that the system 10 may be configured so that if a bus 19 becomes delayed by more than a maximum length of time, such as fifteen minutes, the BSCU 14 immediately calls the homes 36 of the remaining students to board the bus 19 in order to notify these homes 36 of the unusual delay and to notify these homes 36 to wait for a notification call.

III. Control Processes

Figure 6:
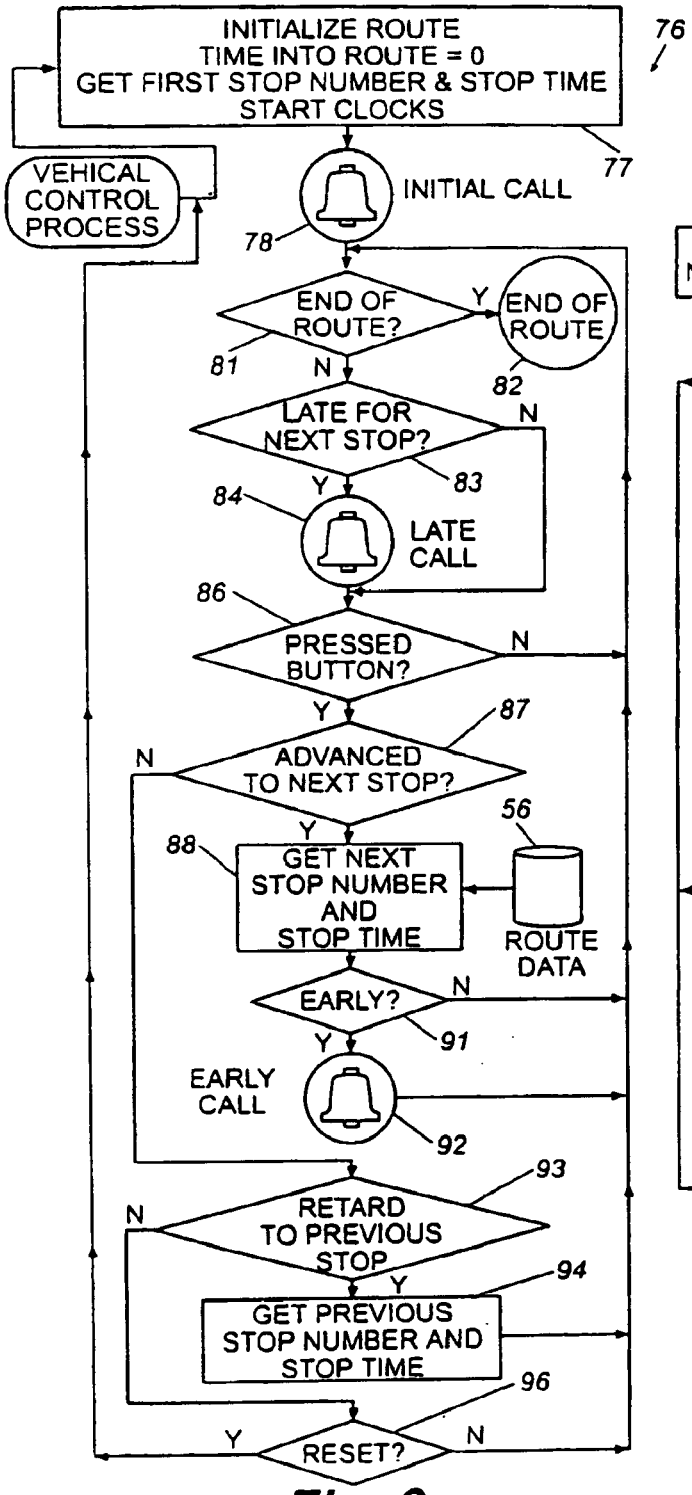
FIG. 6 is a flow chart of a vehicle control process for the VCU of FIGS. 1 and 2.
Figure 7:
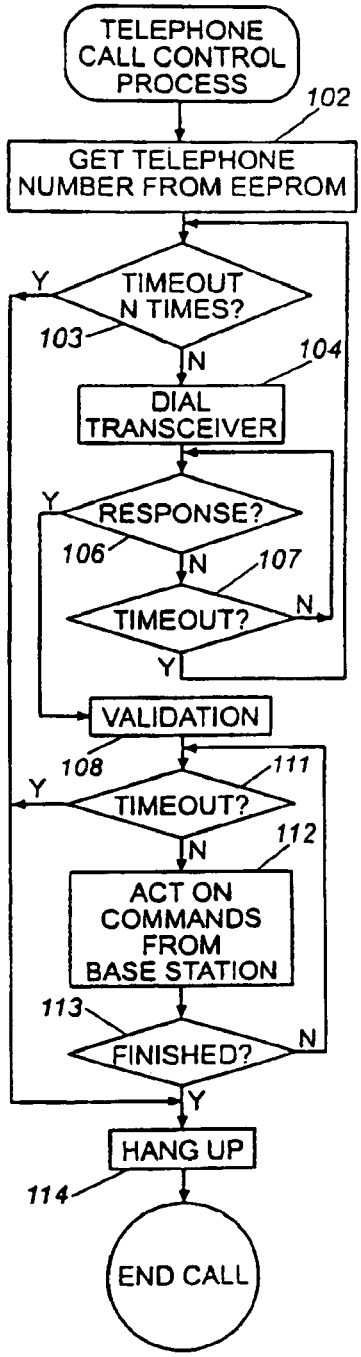
FIG. 7 is a flow chart of a telephone call control process for the VCU of FIGS. 1 and 2.

FIGS. 5 through 7 show flow charts pertaining to control processes or algorithms performed in the advance notification system 10 of FIG. 1 in order to achieve the functionality as set forth in FIGS. 4A and 4B as described hereinbefore. These flow charts illustrate the best mode for practicing the invention at the time of filing this document. More specifically, FIG. 5 illustrates a base station control process 46 employed in the BSCU 14, and FIGS. 6 and 7 show respectively a vehicle control process 76 and a telephone call control process 101 implemented in the VCU 12. The foregoing control processes are merely examples of plausible control algorithms, and an infinite number of control algorithms may be employed to practice the present invention. Furthermore, it should be noted that the base station control process 46 of FIG. 5 is implemented via software within any conventional computer system, and the vehicle control process 76 of FIG. 6 and the telephone call control process 101 of FIG. 7 are both implemented via software stored within memory and are run by the microprocessor controller 16. However, these control operations need not be implemented in software and could be implemented perhaps in hardware or even manually by human interaction.

A. Base Station Control Process

With reference to FIG. 5, the base station control program 46 essentially comprises two control subprocesses which run concurrently, namely, (a) a vehicle communications process 47 and (b) a student calling process 48. The vehicle communications process 47 will be described immediately hereafter followed by the student calling process 48.

1. Vehicle Communications Process

The vehicle communications process 47 initially waits for a telephone call from one of the VCUs 12 located on one of the plurality of buses 19, as indicated by a flow chart block 51. The vehicle communications process 47 is preferably capable of monitoring a plurality of telephone connections 26' for receiving information from a plurality of buses 19. As the number of buses 19 is increased, the number of telephone connections 26' which are monitored by the vehicle communications program 47 should also be increased to an extent.

After the start of a bus 19 along its route, the respective VCU 12 will initiate a telephone call to the BSCU 14, as indicated by the telephone bell symbol 52. After the BSCU 14 receives the telephone call, a string of symbols is exchanged between the VCU 12 and the BSCU 14 so as to validate the communication connection, as indicated in a flow chart block 53. In other words, the BSCU 14 ensures that it is in fact communicating with the VCU 12, and vice versa.

Next, as shown in a flow chart block 54, the BSCU 14 asks the VCU 12 for information regarding (a) the time into the route and (b) the number designating the next stop. In addition, route data 56 is obtained from a local data base. The route data 56 includes information pertaining to each bus stop and how much time it should take to reach each bus stop during the route. From the route data 56 and the information (a) and (b) received from the VCU 12, the BSCU 14 can determine whether the bus 19 is late or early, as indicated by flow chart blocks 57, 58, or whether the bus 19 has just started its route, as indicated by a flow chart block 59. In the case where the bus 19 is late, the BSCU 14 advises the VCU 12 to reset its on-board clock 24 back so that it thinks it is on time, as indicated in a flow chart block 61. In the case where the bus 19 is early, the BSCU 14 advises the VCU 12 to move its on-board clock 24 forward so that the VCU 12 thinks it is on time, as indicated in flow chart block 62. Moreover, in the situation where the bus 19 has just started its route and the telephone call is essentially the first call of the route, the base station clock 28 and the on-board vehicle clock 24 are synchronized, as indicated in a flow chart block 63.

Finally, as shown in a flow chart block 64, the BSCU 14 informs the VCU 12 to terminate the telephone call, which was initiated in the flow chart block 51. The vehicle communications program 47 then proceeds once again to the flow chart block 51, where it will remain until receiving another telephone call from the bus 19.

Worth noting from the foregoing discussion is the fact that the BSCU 14 is the ultimate controller of the advance notification system 10 from a hierarchical vantage point. The base station clock 28 maintains the absolute time of the advance notification system 10, while the vehicle clock 24 assumes a subservient role and is periodically reset when the bus 19 is at the start of a route or when the bus 19 is either early or late during the route. Further, it should be noted that the VCU 12 communicates to the BSCU 14 only (a) when the bus 19 is at the start of a route, (b) when the bus 19 is either early or late during the route, and (c) when the bus 19 completes its route, so as to minimize the amount of time on the mobile telephone network and associated costs thereof.

2. Student Calling Process

As previously mentioned, the student calling process 48 runs concurrently with the vehicle communications process 47 within the BSCU 14. In essence, the student calling process 48 uses the timing information retrieved from the bus 19 by the vehicle communications process 47 in order to call students and inform them of the approaching bus 19. A student list 66 is locally accessible from a local data base by the BSCU 14 and comprises information regarding (a) student names, (b) student telephone numbers, and (c) the time into a bus route when a student should be called via telephone. In accordance with the student calling process 48, as indicated in a flow chart block 67, the student list 66 is consulted as time progresses and telephone numbers are retrieved. When a particular time for calling a particular student is reached, the student calling process 48 initiates a telephone call to the particular student, as shown in flow chart blocks 68, 69. The telephone call can be made by using a distinctive telephone ring or a predefined number of rings, as described previously. Moreover, the particular time is fully selectable by programming.

Also worth noting is that the process can also include a feature for monitoring calls to be placed in the future. In accordance with this feature, upon anticipation of a heavy load of calls, some of the calls would be initiated earlier than the originally scheduled, corresponding call time.

After the bus route has been completed by the bus 19, the particular bus and bus route are removed from consideration, as indicated by flow chart blocks 71, 72. Otherwise, the student calling program 48 returns to the student list 66 and searches for the next student to be called.

As further shown in FIG. 5, an event list 73 is maintained for diagnostics and system monitoring. The event list 73 receives data from both the vehicle communications process 47 and the student calling process 46. The event list 73 essentially comprises records of, among other things, all telephone calls and all past and current bus locations.

B. Vehicle Control Process

Reference will now be made to the vehicle control process 76 shown in FIG. 6. Initially, as indicated in the flow chart block 77 of the vehicle control process 76, the VCU 12 runs through an initiation procedure in which the first stop number is retrieved, the stop time (time necessary to travel to the next stop) is retrieved, and the time into the route as indicated by the clock 24 is set at zero and the clock 24 is started. After the foregoing initialization procedure, a call is initiated via the transceiver 18 to the BSCU 14, as indicated by the bell symbol 78. After the connection, the VCU 12 and the BSCU 14 exchange information as described hereinbefore and which will be further described hereinafter relative to FIG. 7.

Next, as shown in FIG. 6, the vehicle control process 76 begins a looping operation wherein the VCU 12 continuously monitors the switches 21–23, clock 24, and sensors 25*a*–25*e*, if present, to determine whether the bus 19 is early or late. As mentioned previously, the vehicle control process 76 initiates a call only at start-up of a route, or when the bus 19 is either early or late, and not when the bus 19 is on time.

While in the main looping operation, a determination is first made as to whether the bus 19 has reached the end of the route, as indicated in a decisional flow chart block 81. If the bus 19 is at the end of its route, then the vehicle control process 76 stops, as indicated in a flow chart block 82, and does not start unless the start/reset switch 21 is triggered by the bus driver. Otherwise, the process 76 continues and makes a determination as to whether the bus 19 is late for the next stop, as indicated in a decisional flow chart block 83. In the preferred embodiment, the bus 19 is considered late if the bus 19 arrives at a stop more than a predetermined late time period, such as 50 seconds, after when it should have arrived. If the bus 19 is late, then a call is initiated to the BSCU 14, as shown by a bell symbol 84 in FIG. 7.

If the bus is not late, then the process 76 determines whether any of the switches 21, 22, 23 have been actuated, as indicated in a decisional flow chart block 86. If none of the switches 21, 22, 23 have been actuated, then the process 76 will loop back around and begin flow chart block 81 once again. Otherwise, if actuation of a switch 21, 22, 23 is detected, then the process 76 will determine which of the switches 21, 22, 23 has been actuated.

First, the process 76 will determine whether the move forward switch 22 has been actuated, as indicated in the decision flow chart block 87. If the bus driver has actuated the move forward switch 22, then the VCU 12 will retrieve the next stop number and corresponding stop time, as indicated in flow chart block 88, from a local data base having the route data 56. Moreover, a decision will be made as to whether the 5 bus 19 is early for that particular stop, as indicated in the decision flow chart block 91. In the preferred embodiment, the bus 19 is considered early if the bus 19 arrives at a stop more than a predetermined early time period, such as 50 seconds, earlier than when it should have arrived. If the bus is not early, then the process 76 will loop back and proceed again with the flow chart block 81. Otherwise, a call will be initiated to the BSCU 14 to inform the unit 14 that the bus 19 is early, as illustrated by bell symbol 92 in FIG. 7.

In the event that the bus driver has not actuated the move forward switch 22, the process 76 proceeds to a decisional flow chart block 93 wherein the process 76 determines whether the move backward switch 23 has been actuated by the bus driver. If the move backward switch 23 has been actuated, then the process 76 obtains the previous stop number and stop time, as indicated in flow chart block 94, displays these values on the display screen, and loops back to begin again with the flow chart block 81.

In the event that the bus driver has not actuated the move backward switch 23, then the process 76 determines whether the bus driver has actuated the start/reset switch 21, as indicated in the decisional flow chart block 96. If the start/reset switch 23 has not been actuated by the bus driver, then the process 76 loops back and begins again with the flow chart block 81. Otherwise, the process 76 loops back and begins again with the flow chart block 77.

C. Telephone Call Control Process

When a telephone call is initiated by the VCU 12 as indicated by the call symbols 78, 84, 92, the VCU 12 follows a telephone call control process 101 as illustrated in FIG. 7. Initially, the telephone number corresponding with the BSCU 14 is obtained from the EEPROM 43, as indicated in a flow chart block 102. Other information is also obtained, including among other things, the particular bus number, bus serial number, and bus route. Next, the control process 101 sets a time out variable to keep track of how many times a telephone connection has been initiated. The number n of allowable attempts is predetermined and is stored in the EEPROM 43.

After the time out variable has been implemented as indicated in the flow chart block 103, the VCU call control program 101 causes the transceiver 18 to be called, as indicated in the flow chart block 104. The control process 101 requires the VCU 12 to wait for a response from the BSCU 14. If the VCU 12 does not receive a response within a predetermined time out period, preferably 20 seconds, then the control process 101 loops back and begins again at the flow chart block 103. Otherwise, when the control process 101 determines that a response has been received, a validation procedure ensues, as indicated in a flow chart block 108. The validation process indicated at the flow chart block 108 is that which was described previously relative to the flow chart block 53 of FIG. 5. Essentially, it involves the exchange of symbols in order to assure a proper connection.

At the commencement of the validation process, another time out variable is set and will trigger termination of the telephone connection after a predetermined time period has run. The initiation of the time out variable and monitoring of the same is indicated in FIG. 7 at flow chart block 111. If the time out variable triggers termination of the telephone connection, then the control process 101 will hang up and end the call, as illustrated by a flow chart block 114. Otherwise, when the validation procedure has fully commenced, commands are passed from the BSCU 14 to the VCU 12, as shown by a flow chart block 112. Commands which may be sent to the VCU 12 include, for example, the following: (1) Is the bus 19 either early or late?; (2) Reset the vehicle clock 24; (3) Record new information in the EEPROM 43. It should be emphasized that the BSCU 14 may change the route information contained within the EEPROM 43 of the particular bus 19. The foregoing features enables extreme flexibility of the advance notification system 10.

Furthermore, the control process 101 determines whether the BSCU 14 has finished its communication over the mobile telephone, as indicated in a flow chart block 113. Again, the VCU call control program 101 utilizes another time out variable to determine whether the BSCU 14 has finished. After the predetermined time period of the time out variable, the control process 101 will assume that the BSCU 14 has terminated its communication, and accordingly, the control process 101 will hang up the telephone, as indicated in a flow chart block 114. Otherwise, the control process 101 will loop back and begin with the flow chart block 111 in order to accept another command from the BSCU 14.

What is claimed is:

1. A method, comprising the steps of:

monitoring travel data associated with the vehicle;

comparing planned timing of the vehicle along a route to updated vehicle status information;

contacting a user communications device before the vehicle reaches a vehicle stop along the route; and informing the user of the vehicle delay with respect to the vehicle stop and of updated impending arrival of the vehicle at the vehicle stop, based upon the updated vehicle status information and the planned timing.

2. A system, comprising:

means for monitoring travel data associated with a vehicle;

means for comparing planned timing of the vehicle along a route to updated vehicle status information;

means for contacting a user communications device before the vehicle reaches a vehicle stop along the route; and means for informing the user of the vehicle delay with respect to the vehicle stop and of updated impending arrival of the vehicle at the vehicle stop, based upon the updated vehicle status information and the planned timing.

3. The method of claim 1, wherein the comparing step includes the step of evaluating the vehicle's current location to a scheduled location in order to determine if the vehicle is on time or late.

4. The method of claim 1, wherein the step of comparing includes the step of evaluating the vehicle's progress along the route in terms of time with respect to a scheduled time that the vehicle should reach a location.

5. The method of claim 1, wherein the route has a plurality of vehicle stops and wherein the comparing step is performed based upon the vehicle's progress along the stops of the route.

6. The method of claim 1, wherein the travel data comprises scheduled stop information.

7. The method of claim 6, further comprising the step of updating the scheduled stop information based upon tracking information pertaining to the vehicle.

8. The method of claim 1, wherein the method is performed by a computer system that is a single computer or that comprises a distributed architecture with a plurality of computers that are communicatively coupled.

9. The method of claim 2, wherein the means for comparing includes a means for evaluating the vehicle's current location to a scheduled location in order to determine if the vehicle is on time or late.

10. The method of claim 2, wherein the means for comprising includes a means for evaluting the vehicle's progress along the route in terms of time with respect to a scheduled time that the vehicle should reach a location.

11. The system of claim 2, wherein the route has a plurality of vehicle stops and wherein the means for comparing analyzes the vehicle's progress along the stops of the route.

12. The system of claim 2, wherein the travel data comprises scheduled stop information.

13. The system of claim 12, further comprising a means for updating the scheduled stop information based upon tracking information pertaining to the vehicle.

14. The system of claim 2, wherein the system is a single computer or comprises a distributed architecture with a plurality of computers that are communicatively coupled.

* * * * *

US007030781C1

(12) EX PARTE REEXAMINATION CERTIFICATE (9736th)

United States Patent

Jones

(10) Number: US 7,030,781 C1

(45) Certificate Issued: *Jul. 2, 2013

(54) NOTIFICATION SYSTEM AND METHOD THAT INFORMS A PARTY OF VEHICLE DELAY

(75) Inventor: Martin Kelly Jones, Dalton, GA (US)

(73) Assignee: Melvino Technologies, Limited, Tortola (VG)

Reexamination Request:
No. 90/012,612, Jan. 4, 2013

Reexamination Certificate for:

| | |
|---|---|
| Patent No.: | **7,030,781** |
| Issued: | **Apr. 18, 2006** |
| Appl. No.: | **10/686,925** |
| Filed: | **Oct. 16, 2003** |

( * ) Notice: This patent is subject to a terminal disclaimer.

Related U.S. Application Data

(63) Continuation of application No. 09/992,817, filed on Nov. 6, 2001, now Pat. No. 6,700,507, which is a continuation of application No. 09/233,795, filed on Jan. 19, 1999, now Pat. No. 6,313,760, which is a continuation of application No. 08/407,319, filed on Mar. 20, 1995, now abandoned, which is a continuation-in-part of application No. 08/063,533, filed on May 18, 1993, now Pat. No. 5,400,020.

(51) Int. Cl.
*G08G 1/123* (2006.01)

(52) U.S. Cl.
USPC ..... 340/994; 340/989; 701/465; 701/517

(58) Field of Classification Search
None
See application file for complete search history.

(56) References Cited

To view the complete listing of prior art documents cited during the proceeding for Reexamination Control Number 90/012,612, please refer to the USPTO's public Patent Application Information Retrieval (PAIR) system under the Display References tab.

*Primary Examiner* — Adam Basehoar

(57) ABSTRACT

An advance notification system and method notifies passengers of the impending arrival of a transportation vehicle, for example, a school bus, at a particular vehicle stop. The system generally includes an on-board vehicle control unit for each vehicle and a base station control unit for making telephone calls to passengers in order to inform the passengers when the vehicle is a certain predefined time period and/or distance away from the vehicle stop. The VCU compares elapsed time and/or traveled distance to the programmed scheduled time and/or traveled distance to determine if the vehicle is on schedule. If the vehicle is behind or ahead of schedule, the VCU calls the BSCU, which then adjusts its calling schedule accordingly.

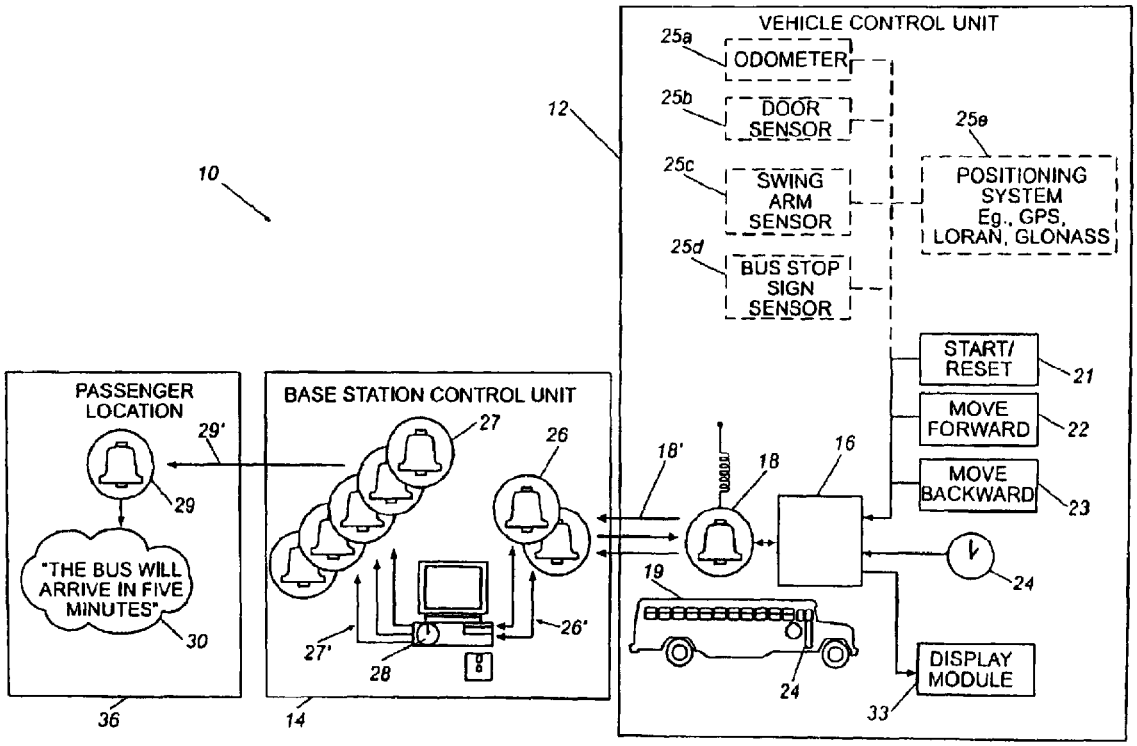

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 5 and 11 is confirmed.

Claims 1-4, 6-10 and 12-14 are cancelled.

* * * * *